US006654718B1

(12) United States Patent
Maeda et al.

(10) Patent No.: US 6,654,718 B1
(45) Date of Patent: Nov. 25, 2003

(54) SPEECH ENCODING METHOD AND APPARATUS, INPUT SIGNAL DISCRIMINATING METHOD, SPEECH DECODING METHOD AND APPARATUS AND PROGRAM FURNISHING MEDIUM

(75) Inventors: Yuuji Maeda, Tokyo (JP); Masayuki Nishiguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 459 days.

(21) Appl. No.: 09/595,400

(22) Filed: Jun. 17, 2000

(30) Foreign Application Priority Data

Jun. 18, 1999 (JP) ..... P11-173354

(51) Int. Cl.[7] ..... G10L 19/00
(52) U.S. Cl. ..... 704/229; 704/219; 704/221
(58) Field of Search ..... 704/229, 200, 704/208, 214, 219, 221, 500

(56) References Cited

U.S. PATENT DOCUMENTS 5,341,456 A * 8/1994 DeJaco ..... 704/214
5,611,019 A * 3/1997 Nakatoh et al. ..... 704/233
5,867,815 A * 2/1999 Kondo et al. ..... 704/228
6,167,375 A * 12/2000 Miseki et al. ..... 704/229
6,202,046 B1 * 3/2001 Oshikiri et al. ..... 704/233
6,240,387 B1 * 5/2001 DeJaco ..... 704/221
6,360,199 B1 * 3/2002 Yokoyama ..... 704/214

* cited by examiner

*Primary Examiner*—Daniel Abebe
(74) *Attorney, Agent, or Firm*—Jay H. Maioli

(57) ABSTRACT

In a speech codec, the total number of transmitted bits is reduced to decrease the average amount of bit transmission by imparting a relatively large number of bits to the voiced speech having a crucial meaning in a speech interval and by sequentially decreasing the number of bits allocated to the unvoiced sound and to the background noise. To this end, such a system is provided which includes an rms calculating unit 2 for calculating a root means square value (effective value) of a filtered input speech signal supplied at an input terminal 1, a steady-state level calculating unit 3 for calculating the steady-state level of the effective value from the rms value, a divider 4 for dividing the output rms value of the rms calculating unit 2 by an output min_rms of the steady-state level calculating unit 3 to determine a quotient rmsg and a fuzzy inference unit 9 for outputting a decision flag decflag from a logarithmic amplitude difference wdif from a logarithmic amplitude difference calculating unit 8.

9 Claims, 17 Drawing Sheets

| | $\mu_{A11}(x_1)$ | $\mu_{A21}(x_1)$ | $\mu_{A31}(x_1)$ |
|---|---|---|---|
| $x_1 \leqq 1$ | 1 | 1 | 0 |
| $1 \leqq x_1 \leqq 2$ | $2-x_1$ | $2-x_1$ | $x_1-1$ |
| $x_1 \leqq 2$ | 0 | 0 | 1 |

FIG.6

| | $\mu_{A12}(x_1)$ | $\mu_{A22}(x_1)$ | $\mu_{A32}(x_1)$ |
|---|---|---|---|
| $x_2 \leqq 0.1$ | $x_2/0.1$ | 0 | $1-x_2/0.1$ |
| $0.1 \leqq x_2 \leqq 0.125$ | 1 | 0 | 0 |
| $0.125 \leqq x_2 \leqq 0.225$ | $(0.225-x_2)/0.1$ | $(x_2-0.125)/0.1$ | 0 |
| $0.225 \leqq x_2 \leqq 0.3$ | 0 | 1 | 0 |
| $0.3 \leqq x_2 \leqq 0.4$ | 0 | $(0.4-x_2)/0.1$ | $(x_2-0.3)/0.1$ |
| $0.4 \geqq x_2$ | 0 | 0 | 1 |

FIG.7

| | $\mu_{B1}(y)$ | $\mu_{B2}(y)$ | $\mu_{B3}(y)$ |
|---|---|---|---|
| $0 \leqq y \leqq 1/6$ | 1 | 0 | 0 |
| $1/6 \leqq y \leqq 1/2$ | $3 \cdot (1/2-y)$ | $3 \cdot (y-1/6)$ | 0 |
| $1/2 \leqq y \leqq 5/6$ | 0 | $3 \cdot (5/6-y)$ | $3 \cdot (y-1/2)$ |
| $5/6 \leqq y \leqq 1$ | 0 | 0 | 1 |

FIG.8

| UNVOICED SOUND | | VOICED SOUND | | BACKGROUND NOISE (ON UPDATING) | | BACKGROUND NOISE (NOT ON UPDATING) | |
|---|---|---|---|---|---|---|---|
| PARAMETERS | NUMBER OF BITS | PARAMETERS | NUMBER OF BITS | PARAMETERS | NUMBER OF BITS | PARAMETERS | NUMBER OF BITS |
| HEADER BIT | | | | | | | |
| i dVUV | 2 | i dVUV | 2 | i dVUV | 2 | i dVUV | 2 |
| — | — | | | UPDATE FLAG | 1 | UPDATE FLAG | 1 |
| LSP PARAMETER | | | | | | | |
| LSP0 | 5 | LSP0 | 5 | LSP0 | 5 | — | — |
| LSP2 | 7 | LSP2 | 7 | LSP2 | 7 | — | — |
| LSP3 | 5 | LSP3 | 5 | LSP3 | 5 | — | — |
| LSP4 | 1 | LSP4 | 1 | LSP4 | 1 | — | — |
| LSP5 | 8 | — | — | — | — | — | — |
| PITCH PARAMETERS | | | | | | | |
| PCH | 7 | | | | | | |
| Am Shape | | CelpShape | | | | | |
| i dS0 | 4 | i dSL00 | 6 | — | — | — | — |
| i dS1 | 4 | i dSL01 | 6 | — | — | — | — |
| Am Gain | | CelpGain | | | | | |
| i dG | 5 | i dGL00 | 4 | i dGL00 | 4 | — | — |
| — | — | i dGL01 | 4 | — | — | — | — |
| Am Shape/4k | | | | | | | |
| i dS0_4k | 7 | — | — | — | — | — | — |
| i dS1_4k | 10 | — | — | — | — | — | — |
| i dS2_4k | 9 | — | — | — | — | — | — |
| i dS3_4k | 6 | — | — | — | — | — | — |
| total | 80 | total | 40 | total | 25 | total | 3 |

FIG.12

| BIT | 0 | 1 | 2 |
|---|---|---|---|
| UNVOICED SPEECH | 0 | 0 | d |
| NOT UPDATE BGN | 0 | 1 | 0 |
| UPDATE BGN | 0 | 1 | 1 |
| VOICED SPEECH | 1 | d | d |

(d = DON'T CARE)

FIG.16

TRANSMISSION SYSTEM

SPEECH ENCODING METHOD AND APPARATUS, INPUT SIGNAL DISCRIMINATING METHOD, SPEECH DECODING METHOD AND APPARATUS AND PROGRAM FURNISHING MEDIUM

BACKGROUND OF THE INVENTION

1. Field of the Invention

This invention relates to an encoding method and apparatus for encoding an input speech signal as the bitrate in the unvoiced interval is varied from that in the voiced interval. This invention also relates to a method and apparatus for decoding encoded data encoded in and transmitted from the encoding method and apparatus, and to a program furnishing medium for executing the encoding method and the decoding method by software-related technique.

2. Description of Related Art

Recently, in the field of communication in need of a transmission path, it is being contemplated, with a view to realizing efficient utilization of a transmission band, to vary the encoding rate of the input signal to be transmitted, depending on the sort of the input signal, such as speech signal interval classed into e.g., the voiced sound and the unvoiced sound, or the background noise interval, before transmitting the input signal.

For example, if a given interval is verified to be a background noise interval, it has been contemplated not to send the encoded parameters but to simply mute the interval, without the decoding device generating particularly the background noise.

This however renders the call unnatural since the background noise is superposed on the speech uttered by a counterpart of communication and, in the absence of the speech, a silent state suddenly is produced.

In this consideration, the conventional practice has been such that, if a given interval is verified to be a background noise interval, several encoded parameters are not sent, with the decoding device then generating the background noise by repeatedly employing past parameters.

However, if past parameters are consistently used in a repeated fashion, an impression is imparted that the noise itself has a pitch, so that an unnatural noise is generated. This occurs even if the level etc is changed, as long as the line spectrum pair (LSP) parameters remain the same.

SUMMARY OF THE INVENTION

It is therefore an object of the present invention to provide a speech encoding method and apparatus, input signal discriminating method, speech decoding method and apparatus, and a program furnishing medium, in which, in speech codec, a relatively large number of transmission bits is imparted to the voiced speech crucial in the speech interval, with the number of bits being decreased in the sequence of the unvoiced speech and the background noise to suppress the total number of transmission bits and to reduce the average amount of transmission bits.

In one aspect, the present invention provides a speech encoding apparatus for effecting encoding at a variable rate between voiced and unvoiced intervals of an input speech signal, including input signal verifying means for dividing the input speech signal in a pre-set unit on the time axis and for verifying whether the unvoiced interval is a background noise interval or a speech interval based on time changes of the signal level and the spectral envelope in the pre-set unit, wherein allocation of encoding bits is differentiated between parameters of the background noise interval, parameters of the speech interval and parameters of the voiced interval.

In another aspect, the present invention provides a speech encoding method for effecting encoding at a variable rate between voiced and unvoiced intervals of an input speech signal, including an input signal verifying step for dividing the input speech signal in a pre-set unit on the time axis and for verifying whether the unvoiced interval is a background noise: interval or a speech interval based on time changes of the signal level and the spectral envelope in the pre-set unit, wherein allocation of encoding bits is differentiated between parameters of the background noise interval, parameters of the speech interval and parameters of the voiced.

In still another aspect, the present invention provides a method for verifying an input signal including a step for dividing the input speech signal in a pre-set unit and for finding time changes of the signal level in the pre-set unit, a step for finding time changes of the spectral envelope in the unit, and a step for verifying a possible presence of background noise based on the time changes of the signal level and the spectral envelope.

In still another aspect, the present invention provides a decoding apparatus for decoding encoded bits with different bit allocation to parameters of an unvoiced interval and parameters of a voiced interval, including verifying means for verifying whether an interval in said encoded bits is a speech interval or a background noise interval and decoding means for decoding the encoded bits at the background noise interval by using LPC (Linear Prediction Coding) coefficients received at present or at present and in the past, CELP (Code Excitation Linear Prediction) gain indexes received at present or at present and in the past and CELP shape indexes generated internally at random if the information indicating the background noise interval is taken out by said verifying means.

In still another aspect, the present invention provides a decoding method for decoding encoded bits with different bit allocation to parameters of an unvoiced interval and parameters of a voiced interval, including a verifying step for verifying whether an interval in said encoded bits is a speech interval or a background noise interval, and a decoding step for decoding the encoded bits at the background noise interval using LPC coefficients received at present or at present and in the past, CELP gain indexes received at present or at present and in the past and CELP shape indexes generated internally at random.

In still another aspect, the present invention provides a medium for furnishing a speech encoding program for performing encoding at a variable rate between voiced and unvoiced intervals of an input speech signal, wherein the program includes an input signal verifying step for dividing the input speech signal in a pre-set unit on the time axis and for verifying whether the unvoiced interval is a background noise interval or a speech interval based on time changes of the signal level and spectral envelopes in the pre-set unit. The allocation of encoding bits is differentiated between parameters of the background noise interval, parameters of the speech interval and parameters of the voiced interval.

In yet another aspect, the present invention provides a medium for furnishing a speech decoding program for decoding transmitted bits encoded with different bit allocation to parameters of an unvoiced interval and parameters of a voiced interval, wherein the program includes a verifying step for verifying weather an interval in the encoded bits a speech interval or a background noise interval, and a decoding step for decoding the encoded bits at the background noise interval by using LPC coefficients received at present or at present and in the past, CELP gain indexes received at present or at present and in the past and CELP shape indexes generated internally at random.

With the decoding method and apparatus according to the present invention, it is possible to maintain continuity of speech signals to decode high-quality speech.

Moreover, with the program furnishing medium according to the present invention, it is possible for a computer system to maintain continuity of speech signals to decode high-quality speech.

BRIEF DESCRIPTION OF THE DRAWINGS

FIG. 6 shows a membership function concerning a signal level in the fuzzy rule.

FIG. 7 shows a membership function concerning the spectrum in the fuzzy rule.

FIG. 8 shows a membership function concerning the results of inference in the fuzzy rule.

FIG. 12 shows encoding bits in each condition by taking the speech codec HVXC (harmonic vector excitation coding) adopted in MPEG4 as an example.

FIG. 16 shows the structure of header bits.

DESCRIPTION OF THE PREFERRED EMBODIMENTS

Figure 1:
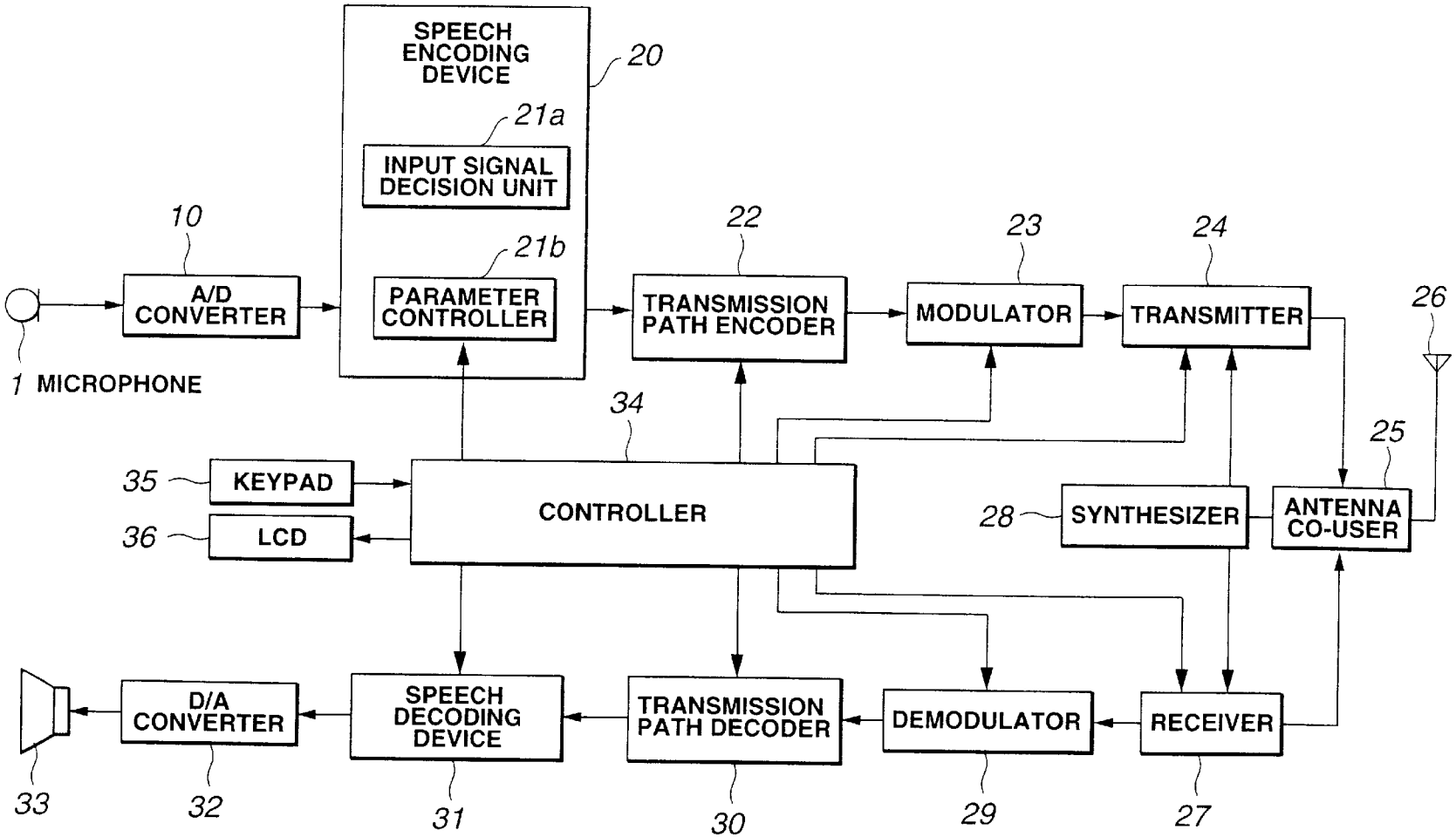
FIG. 1 is a block diagram showing the structure of a portable telephone device embodying the present invention.

Referring to the drawings, preferred embodiments of an encoding method and apparatus and a speech decoding method and apparatus according to the present invention will be explained in detail.

Basically, such a system may be recited in which the speech is analyzed on the transmitting side to find encoding parameters, the encoding parameters are transmitted and the speech is synthesized on the receiving side. In particular, the transmitting side classifies the encoding mode, depending on the properties of the input speech, and varies the bitrate to diminish an average value of the transmission bitrate.

A specified example is a portable telephone device, the structure of which is shown in FIG. 1. This portable telephone device uses an encoding method and apparatus and a decoding method and apparatus according to the present invention in the form of a speech encoding device 20 and a speech decoding device 31 shown in FIG. 1.

The speech encoding device 20 performs encoding such as to decrease the bitrate of the unvoiced (UV) interval of the input speech signal as compared to that of its voiced (V) interval. The speech encoding device 20 also discriminates the background noise interval (non-speech interval) and the speech interval in the unvoiced interval from each other to effect encoding at a still lower bitrate in the non-speech interval. It also discriminates the non-speech interval from the speech interval to transmit the result of the discrimination to the speech decoding device 31.

In the speech encoding device 20, discrimination between the unvoiced interval and the voiced interval in the input speech signal or that between the non-speech interval and the speech interval in the unvoiced interval is by an input signal discriminating unit 21*a*. This input signal discriminating unit 21*a* will be explained in detail subsequently.

First, the structure of the transmitting side is explained. The speech signals, entered at a microphone 1, is converted by an A/D converter 10 into digital signals and encoded at a variable rate by a speech encoding device 20. The encoded signals then are encoded by a transmission path encoder 22 so that the speech quality will be less susceptible to deterioration by the quality of the transmission path. The resulting signals are modulated by a modulator 23 and processed for transmission by a transmitter 24 so as to be transmitted through an antenna co-user 25 over an antenna 26.

On the other hand, a speech decoding device 31 on the receiving side receives a flag indicating whether a given interval is a speech interval or a non-speech interval. If the interval is the non-speech interval, the speech decoding device 31 decodes the interval using LPC coefficients received at present or both at present and in the past, the gain index of CELP (code excitation linear prediction) received at present or both at present and in the past, and the shape index of the CELP generated at random in the decoder.

The structure of the receiving side is explained. The electrical waves, captured by the antenna 26, are received through the antenna co-user 25 by a receiver 27 and demodulated by a demodulator 13 so as to be then corrected for transmission errors by a transmission path decoder 30. The resulting signals are converted by a D/A converter 32 back into analog speech signals which are outputted at a speaker 33.

A controller 34 controls the above-mentioned various portions, whilst a synthesizer 28 imparts the transmission/reception frequency to the transmitter 24 and the receiver 27. A key-pad 35 and an LCD indicator 36 are utilized as a man-machine interface.

Figure 2:
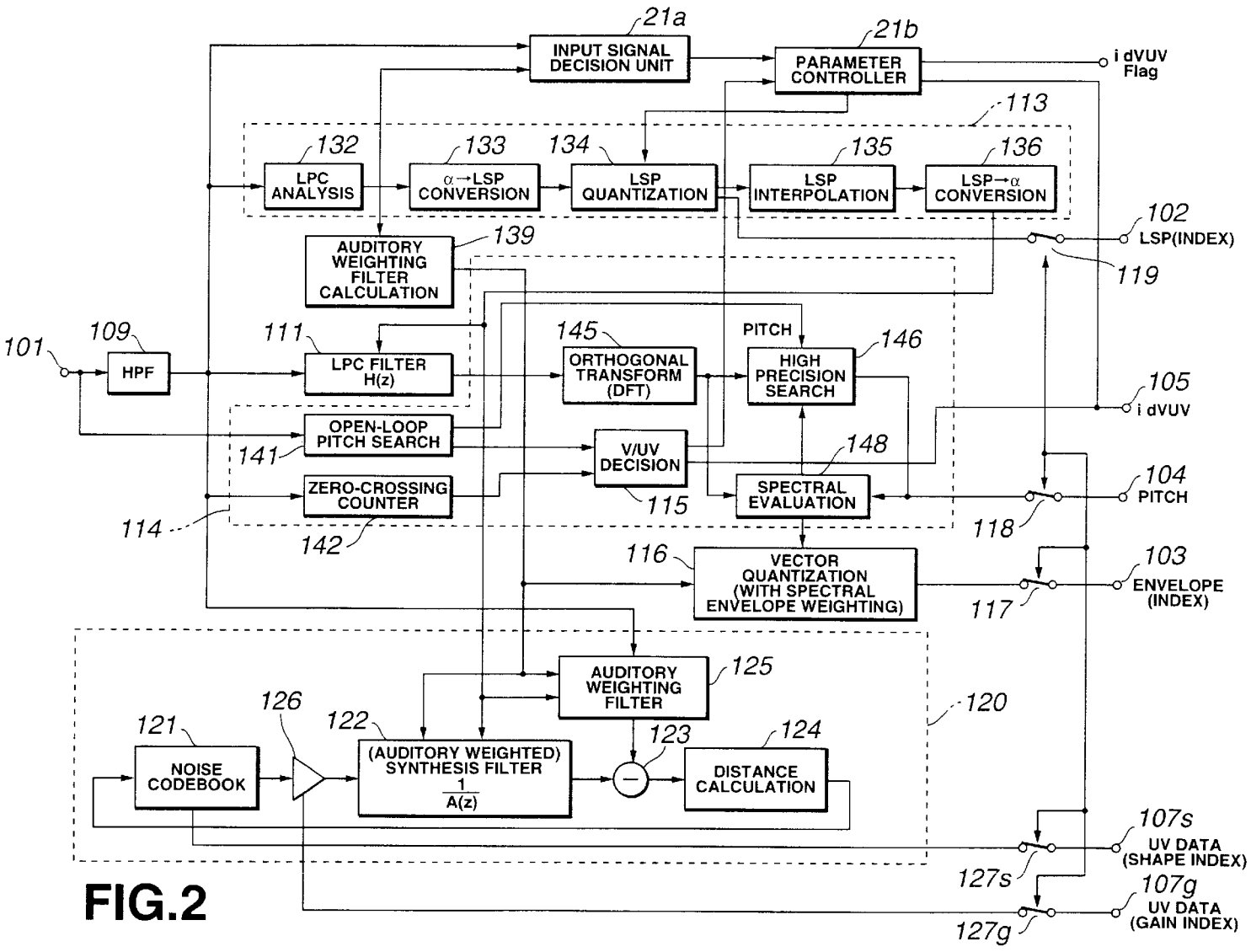
FIG. 2 shows a detailed structure of the inside of the speech encoding device of the portable telephone device excluding the input signal discriminating unit and a parameter controller.
Figure 3:
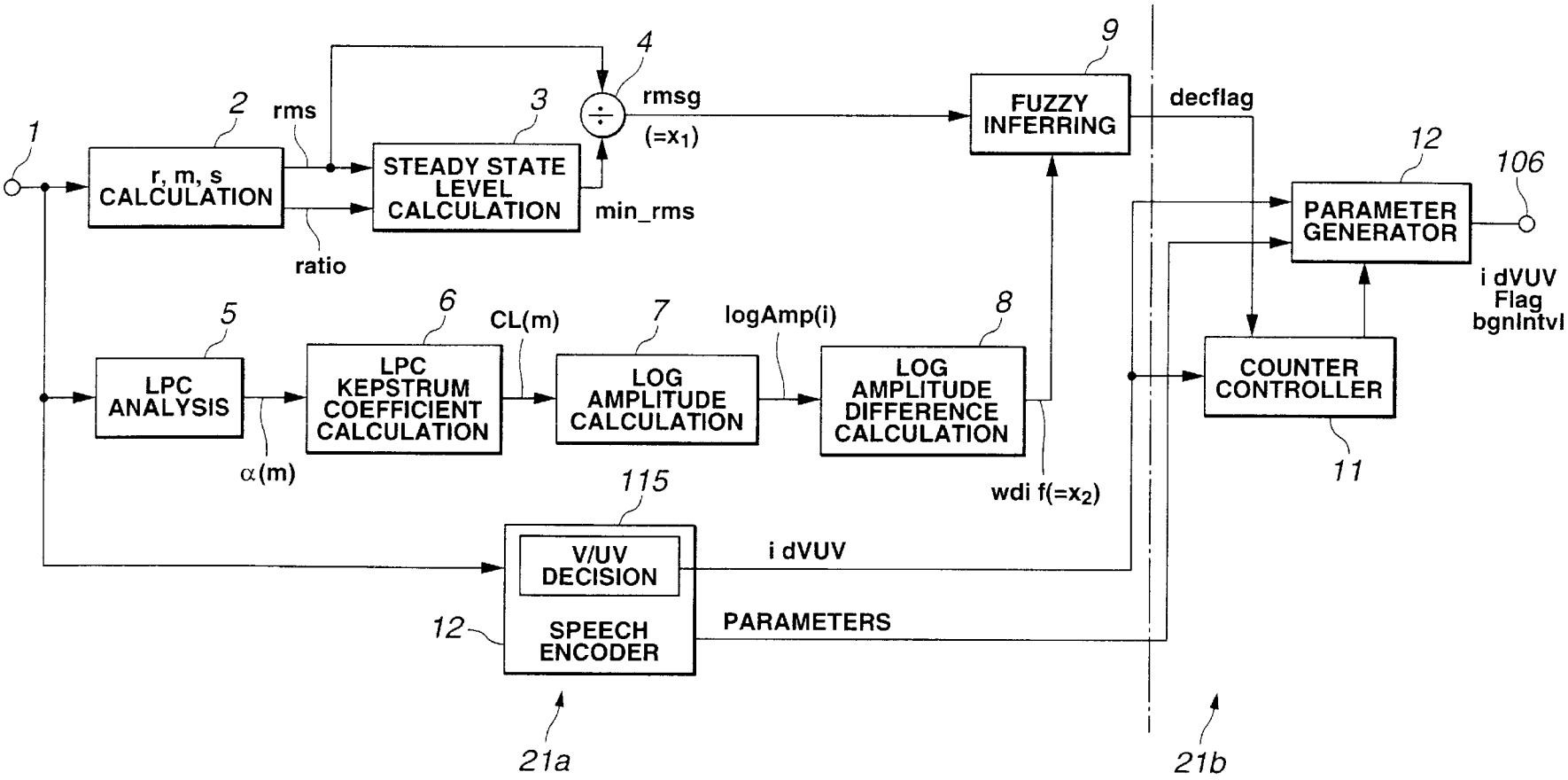
FIG. 3 shows a detailed structure of the input signal discriminating unit and a parameter controller.

The speech encoding device 20 will be explained in detail by referring to FIGS. 2 and 3. FIG. 2 shows a detailed structure of the encoding unit in the inside of the speech encoding device 20, excluding an input signal discriminating unit 21*a* and a parameter controlling unit 21*b*. FIG. 3 shows the detailed structure of the input signal discriminating unit 21*a* and the parameter controlling unit 21*b*.

An input terminal 101 is fed with speech signals sampled at a rate of 8 kHz. The input speech signal is freed of signals of unneeded bands in a high-pass filter (HPF) 109 and thence supplied to the input signal discriminating unit 21*a*, an LPC analysis circuit 132 of an LPC (linear prediction coding) analysis quantization unit 113 and to an LPC back-filtering circuit 111.

Referring to FIG. 3, the input signal discriminating unit 21*a* includes an rms calculating unit 2 for calculating an rms (root-mean-square) value of a filtered input speech signal, fed to the input terminal 1, a steady-state level calculating unit 3, for calculating the steady-state level of the effective value from the effective value rms, a divider 4 for dividing the output rms of the rms calculating unit 2 with an output min_rms of the steady-state level calculating unit 3 to find a quotient $rms_g$, an LPC analysis unit 5 for doing LPC analysis of the input speech signal from the input terminal 1 to find an LPC coefficient α(m), an LPC cepstrum coefficient calculating unit 6 for converting the LPC coefficient α(m) from the LPC analysis unit 5 into an LPC cepstrum coefficient $C_L(m)$ and a logarithmic amplitude calculating unit 7 for finding an average logarithmic amplitude logAmp(i) from the LPC cepstrum coefficient $C_L(m)$ of the LPC cepstrum coefficient calculating unit 6. The input signal discriminating unit 21*a* includes a logarithmic amplitude difference calculating unit 8 for finding the logarithmic amplitude difference wdif from the average logarithmic amplitude logAmp(i) of the logarithmic amplitude calculating unit 7 and a fuzzy inference unit 9 for outputting a discrimination flag decflag from $rms_g$ from the divider 4 and the logarithmic amplitude difference wdif from the logarithmic amplitude difference calculating unit 8. Meanwhile, an encoding unit, shown in FIG. 2, including a V/UV decision unit 115, and adapted for outputting an idVUV decision result, as later explained, from the input speech signal, and for encoding various parameters to output the encoded parameters, is shown in FIG. 3 as a speech encoding unit 13 for convenience in illustration.

The parameter controlling unit 21*b* includes a counter controller 11 for setting the background noise counter bgnCnt based on the idVUV decision result from the V/UV decision unit 115 and the decision result decflag from the fuzzy inference unit 9 and a parameter generating unit 12 for determining an renovation flag Flag and for outputting the flag at an output terminal 106.

The operation of various portions of the input signal discriminating unit 21*a* and the parameter controlling unit 21*b* is now explained in detail. First, the various portions of the input signal discriminating unit 21*a* operate as follows:

The rms calculating unit 2 divides the input speech signal, sampled at a rate of 8 kHz, into 20 msec based frames (160 samples). As for speech analysis, it is executed on overlapping 32 msec frames (256 samples). The input signal s(n) is divided into 8 intervals and the interval power ene(i) is found by the following equation (1):

$$ene(i) = \sum_{n=0}^{31} s(32 \cdot i + n)^2, \quad (i = 0, \ldots, 7). \tag{1}$$

The boundary in maximizing the former to latter side signal interval portion ratio ratio is found from the thus found ene(i) by the following equation (2) or (3):

$$\text{ratio} = \frac{\frac{1}{m}\sum_{i=0}^{m-1} ene(i)}{\frac{1}{8-m}\sum_{i=0}^{7} ene(i)} \tag{2}$$

$$\text{ratio} = \frac{\frac{1}{8-m}\sum_{i=0}^{7} ene(i)}{\frac{1}{m}\sum_{i=0}^{m-1} ene(i)} \tag{3}$$

where the equation (2) is the ratio when the former portion is larger than the latter portions and the equation (3) is the ratio when the latter portion is larger than the former portion.

It is noted that in is limited so that m=2, . . . 6.

The signal effective value rms then is found from the average power of the former or latter portion, whichever is larger, from the thus found boundary m, in accordance with the following equation (4) or (5):

$$\text{rms} = \sqrt{\frac{1}{32 \cdot m)}\sum_{i=0}^{m-1} ene(i)} \tag{4}$$

$$\text{rms} = \sqrt{\frac{1}{32 \cdot (8-m)}\sum_{i-m}^{7} ene(i)} \tag{5}$$

it being noted that the equation, (4) is the effective value rms when the former portion is larger than the latter portions and the equation (5) is the effective value rms when the latter portion is larger than the former portion.

Figure 4:
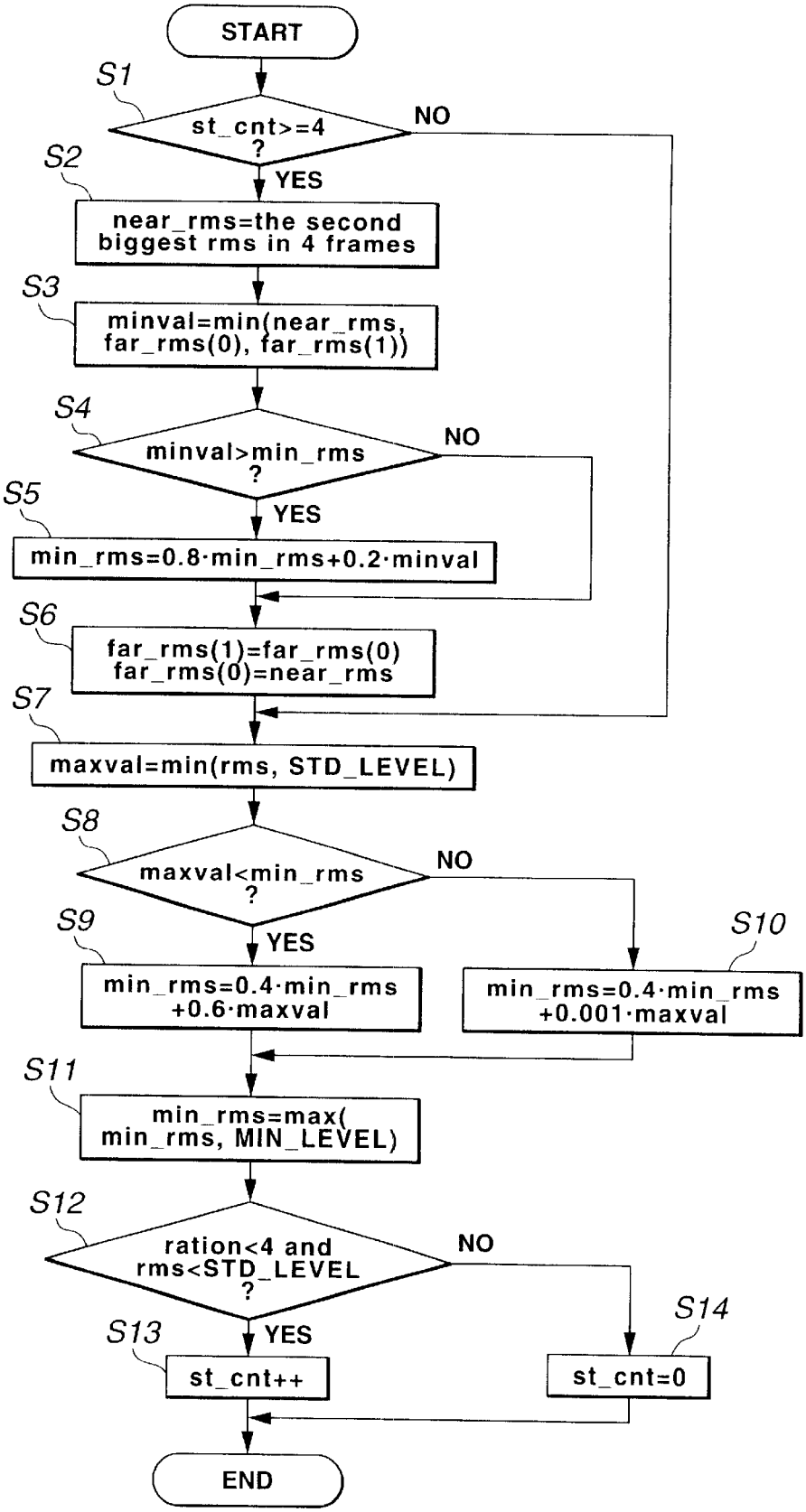
FIG. 4 is a flowchart showing the processing for calculating the steady-state level of rms.

From the above-mentioned effective value rms, the steady-state level calculating unit 3 calculates the steady-state level of the effective value in accordance with the flowchart shown in FIG. 4. At step S1, it is verified whether or not the state of the counter st_cnt based on the stable state of the effective value rms of a past frame is not less than 4. If the result of check at step S1 is YES, the steady-state level calculating unit 3 proceeds to step S2 to set the second largest one of rms values of past consecutive four frames to near_rms. Then, at step S3, a minimum value minval is found from the previous rms, that is far_rms (i) (i=0, 1) and near_rms.

If the minimum value Minval thus found is found at step S4 to be larger than the min_rms as the steady-state rms, the steady-state level calculating unit 3 proceeds to step S5 to update min_rms as shown by the following equation (6):

$$\text{min_rms} = 0.8 \cdot \text{min_rms} + 0.2 \cdot \text{minval} \tag{6}$$

Then, at step S6, far_rms is renovated as shown by the following equations (7) and (8):

$$\text{far_rms}(0) = \text{far_rms}(1) \tag{7}$$

$$\text{far_rms}(1) = \text{near_rms} \tag{8}$$

Then, at step S7, a smaller one of rms and standard level STD_LEVEL is set to max_val, where STD_LEVEL is equivalent to a signal level of the order of −30 dB in order o set an upper level so that malfunction will be prohibited from occurring when the current rms is of a higher signal level. At step S8, maxval is compared to min _rms to update min_rms as follows: That is, if maxval is smaller than min_val, min_rms is renovated only slightly at step S9, as indicated by the equation (9), whereas, if maxval is not smaller than min_val, min_rms is renovated only slightly at step S10, as indicated by the equation (10):

$$min_rms = min_rms + 0.001 \cdot maxval \ (maxval \geqq min_rms) \quad (9)$$

$$min/rms = min_rms + 0.002 \cdot (maxval \geqq min_rms) \quad (10)$$

If, at step S11, min_rms is smaller than the silent level MIN_LEVEL, min_rms =MIN_LEVEL is set, where MIN_LEVEL is of the signal level of the order of −66 dB.

Meanwhile, if at step S12 the former to latter signal portion level ratio ratio is smaller than 4, with the rms being smaller than STD_LEVEL, the frame signal is stable. So, the steady-state level calculating unit 3 proceeds to step S13 to increment the stability indicating counter st_cnt by one and, if otherwise, and hence the steady-state level calculating unit 3 proceeds to step S14 to set st_cnt 0, since the stability then is low. This realizes the targeted steady-state rms.

The divider 4 divides an output rms of the rms calculating unit 2 with the output min_rms of the steady-state level calculating unit 3 to calculate $rms_g$. That is, this $rms_g$ indicates the approximate level of the current rms with respect to the steady-state rms.

The LPC analysis unit 5 then finds, from the input speech signal s(n), the short-term prediction (LPC) coefficient $\alpha(m)$ (m=1 . . . , 10). Meanwhile, an LPC coefficient $\alpha(m)$, as found by the LPC analysis in the interior of the speech encoding unit 13, may also be used. The LPC cepstrum coefficient calculating unit 6 converts the LPC coefficient $\alpha(m)$ into the LPC coefficient $C_L(m)$.

The logarithmic amplitude calculating unit 7 is able to find the logarithmic square amplitude characteristics $\ln|H_L(e^{j}\Omega)|^2$ from the LPC coefficient $C_L(m)$ in accordance with the following equation (11):

$$\ln|H_L(e^{j\Omega})|^2 = 2\sum_{m=0}^{\infty} C_L(m)\cos(\Omega m). \quad (11)$$

Here, however, the upper limit of the sum calculation on the right side of the above equation is set to 16, in place of infinity, and an integral is found to find a interval average logAmp(i) in accordance with the following equations (12) and (13). Meanwhile, CL(0)=0 and hence is omitted.

$$\log Amp(i) = \frac{1}{\omega}\int_{\Omega_i}^{\Omega_{i+1}} \ln\left|H_{L(e^{j\Omega})}\right|^2 d\Omega \quad (12)$$

$$\log Amp(i) = \frac{1}{\omega}\left[2\sum_{m=1}^{16}\frac{1}{m}C_L(m)\sin(\Omega m)\right]_{\Omega_i}^{\Omega_{i+1}}$$

where ω is set to 500 Hz (=π/8) for the average interval ($\omega=\Omega_{i+l}-\Omega_i$). Here, logAmp(i) is computed for i=0, . . . , 3 corresponding to four equal division of the range of 0 to 2 kHz at an interval of 500 Hz.

The logarithmic amplitude difference calculating unit 8 and the fuzzy inference unit 9 are now explained. In the present invention, a fuzzy theory is used for detecting the silent and background noise. The fuzzy inference unit 9 outputs the decision flag decflag, using the value $rms_g$, obtained by the divider 4 dividing the rms by min_rms, and wdif from the logarithmic amplitude difference calculating unit 8, as later explained.

Figures 5A, 5B, 5C:
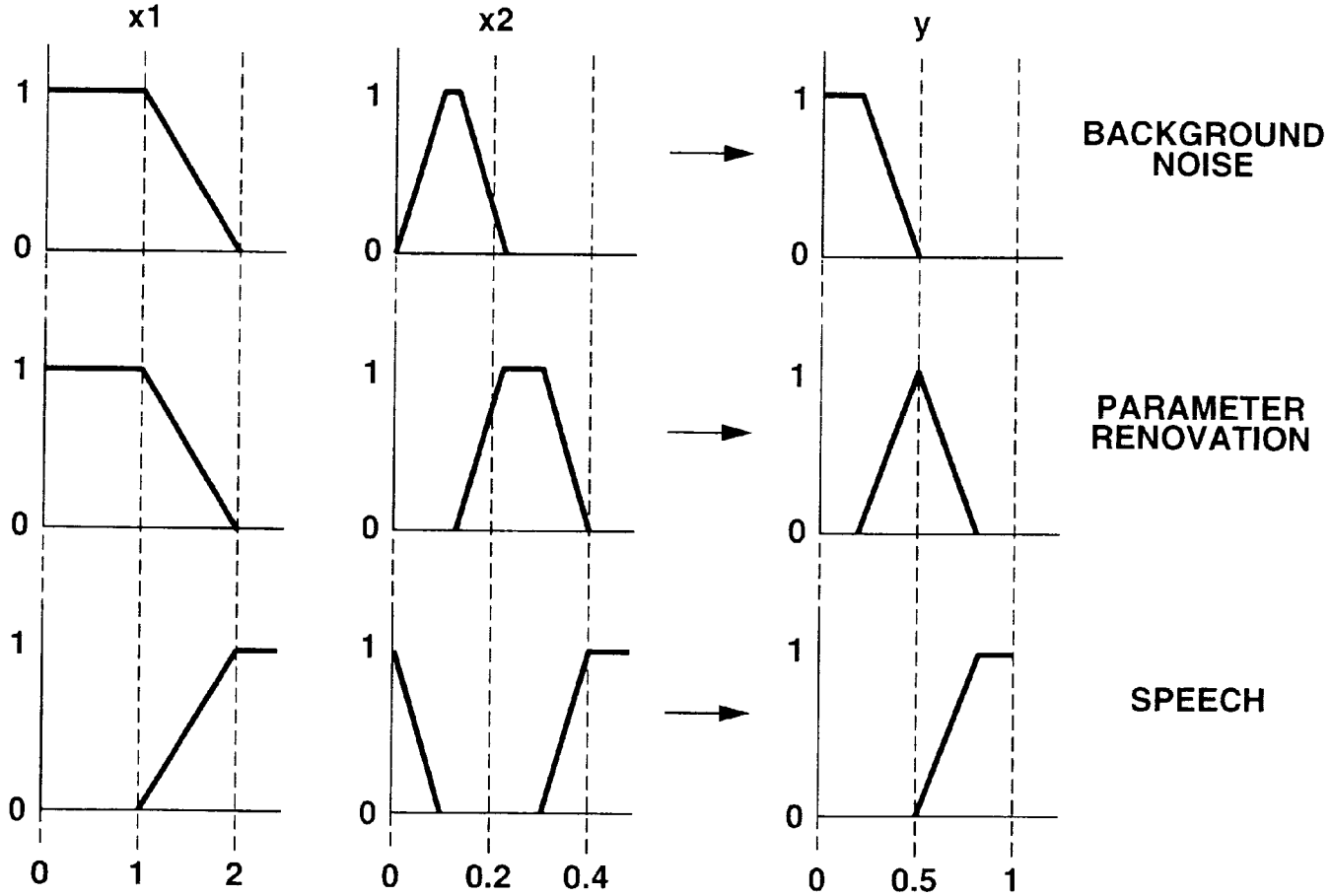
FIG. 5 illustrates a fuzzy rule in a fuzzy inference unit.

FIG. 5 shows the fuzzy rule in the fuzzy inference unit 9. In FIG. 5, an upper row (a), a mid row (b) and a lower row (c) show a rule for the background noise, mainly a rule for noise parameter renovation and a rule for speech, respectively. Also, in FIG. 5, a left column, a mid column and a right column indicate the membership function for the rms, a membership function for a spectral envelope and the results of inference, respectively.

The fuzzy inference unit 9 first classifies the value $rms_g$, obtained by the divider 4 dividing the rms by the min_rms, with the membership function shown on the left column of FIG. 5. From the upper row, the membership function $\mu_{Ail}(x_1)$(i=1, 2, 3) is defined as shown in FIG. 6. Meanwhile, x1=$rms_g$.

On the other hand, the logarithmic amplitude difference calculating unit 8 holds the logarithmic amplitude logAmp (i) of the spectrum of the past n (e.g., four) frames and finds an average value aveAmp (i). The logarithmic amplitude difference calculating unit 8 then finds the square sum wdif of the difference between aveAmp (i) and the current logAmp (i) from the following equation (14):

$$wdif = \sqrt{\frac{1}{4}\sum_{i=0}^{3}(\log Amp(i) - aveaAmp(i))^2}\,. \quad (14)$$

The fuzzy inference unit 9 classifies the wdif, found by logarithmic amplitude difference calculating unit 8 as described above with the membership function shown in the mid row in FIG. 5. From the upper row, the membership function $\mu_{Ail}(x_1)$ (i=1, 2, 3) is defined as shown in FIG. 7, where $x_2$=wdif That is, the membership functions shown in the mid column in FIG. 5 are defined as being $\mu_{A12}(x_2)$, $\mu_{A22}(x_2)$ and $\mu_{A32}(x_2)$, beginning from the upper row (a), mid row (b) and the lower row (c). Meanwhile, if rms is smaller than the above-mentioned constant MIN_LEVEL (silent level), FIG. 7 is not followed, but $\mu_{A12}(x_2)=1$ and $\mu_{A22}(x_2)=\mu_{A32}(x_2)=0$. The reason is that, if the signal is delicate, the spectral variations are more acute than usual thus obstructing the discrimination.

The fuzzy inference unit 9 finds the membership function $\mu_{Bi}(y)$ as the thus found result of inference from $\mu_{Aij}(x_j)$ as follows: First, a smaller one of $\mu_{Ail}(x_1)$ and $\mu_{Ai2}(x_2)$ in each of the upper, mid and low rows of FIG. 5 is set as $\mu_{Bi}(y)$ of the row, as indicated by the following equation (15):

$$\mu_{Bi}(y)=\min(\mu_{Ail}(x_l),\mu_{Ai2}(x_2))(i=1,2,3) \quad (15)$$

it being noted that such a configuration in which, if one of the membership functions $\mu$A31(x1) and $\mu$A32(x2) representing the speech is 1, $\mu_{B1}(y)=\mu_{B2}(y)=0$ and $\mu_{B3}(y)=1$ are outputted.

It is noted that $\mu_{Bi}(y)$ in each stage, obtained from the equation (15), is equivalent to the value of the function of the right column of FIG. 5. The membership function $\mu_{Bi}(y)$ is defined as shown in FIG. 8 that is, the membership functions shown in the right column are defined as $\mu_{Bi}(y)$, $\mu_{B2}(y)$ and $\mu_{B3}(y)$, in the order of the upper row (a), mid row (b) and the lower row (c) shown in FIG. 8.

Based on these values, the fuzzy inference unit 9 makes inference, as it makes discrimination by the area method as indicated by the following equation (16):

$$y^* = \frac{\sum_{i=1}^{3} S_i \cdot y_i^*}{\sum_{i=1}^{3} S_i}, \quad S_i = \int_{\gamma}\mu_{Bi}(y)dy$$

where y* and $y_i$* indicate the results of inference and the center of gravity of the membership finction of each row. In FIG. 5, it is 0.1389, 0.5 and 0.8611 in the order of the upper, mid and lower rows, respectively. Si indicates an area. Using the membership function $\mu_{Bi}(y)$, $S_1$ to $S_3$ may be found from the following equations (17), (18) and (19):

$$S_1=\mu_{Bi}(y)\cdot(1-\mu_{B1}(y)/3)/2 \quad (17)$$

$$S_2=\mu_{B2}(y)\cdot(2/3-\mu_{B2}(y)/3) \quad (18)$$

$$S_3=\mu_{B3}(y)\cdot(1-\mu_{B3}(y)/3)/2 \quad (19)$$

By the values of the results of inference y*, as found from these values, output values of the decision flag decFlag are defined as follows:

| | |
|---|---|
| $0 \leqq y^* \leqq 0.34$ | →decFlag = 0 |
| $0.34 < y^* < 0.66$ | →decFlag = 2 |
| $0.66 \leqq y^* \leqq 1$ | →decFlag = 1 |

where decFlag=0 indicates that the results of decision represent the background noise, decFlag=2 indicates that the parameters need to be renovated, and decFlag=1 indicates the results of speech discrimination.

Figures 9A, 9B, 9C:
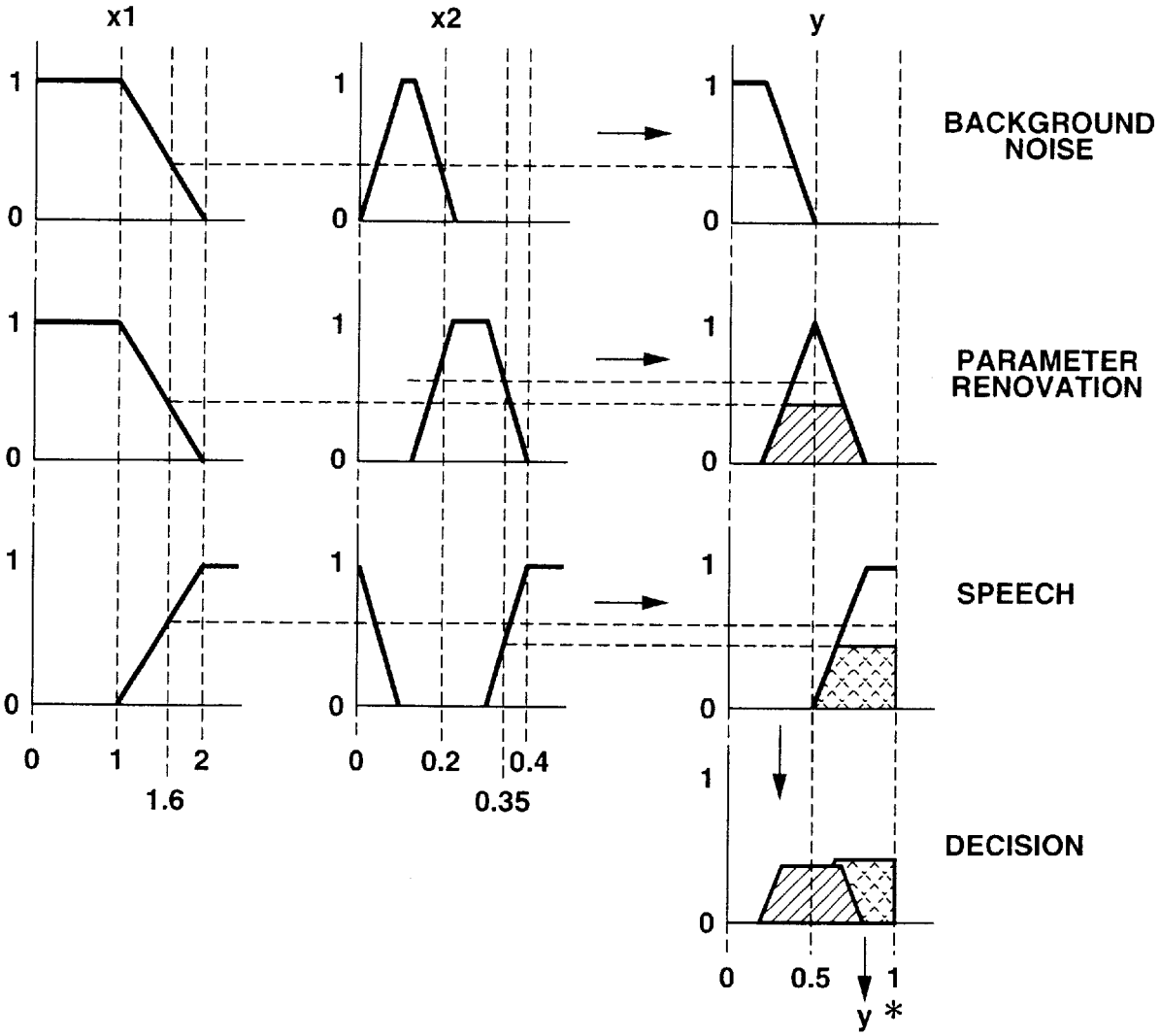
FIG. 9 shows a specified example of inference in the fuzzy inference unit.

FIG. 9 shows a specified example. It is assumed that $x_1=1.6$ and $x_2=0.35$. From these, $\mu_{Aij}(x_j)$, $\mu_{Ai2}(x_2)$ and $\mu_{Bi}(y)$ are defined as follows:

$$\mu_{A11}(x_1)=0.4\mu_{A12}(x_2)=0,\ \mu_{B1}(y)=0$$

$$\mu_{A21}(x_1)=0.4\mu_{A22}(x_2)=0.5,\ \mu_{B2}(y)=0.4$$

$$\mu A_{31}(x)=0.6,\ \mu_{A32}(x_2)=0.5,\ \mu_{B3}(y)=0.5$$

If an area is computed from these, S1=0, S2=0.2133 andS3=0.2083, so that ultimately y*=0.6785 and decFlag=1, thus indicating the speech.

The foregoing is the operation of the input signal discriminating unit 21*a*. The detailed operation of respective portions of the parameter controlling unit 21 b are hereinafter explained.

The counter controller 11 sets the background noise counter bgnCnt and the background noise period counter bgnIntv1 based on the result of decision of idVUV from the V/UV decision unit 115 and the flag decflag from the fuzzy inference unit 9.

The parameter generating unit 12 determines the idVUV parameter and the renovation flag Flag from the bgnIntv1 from the counter controller 11 and the results of discrimination of idVUV to set the renovation flag Flag which is transmitted from the output terminal 106.

Figure 10:
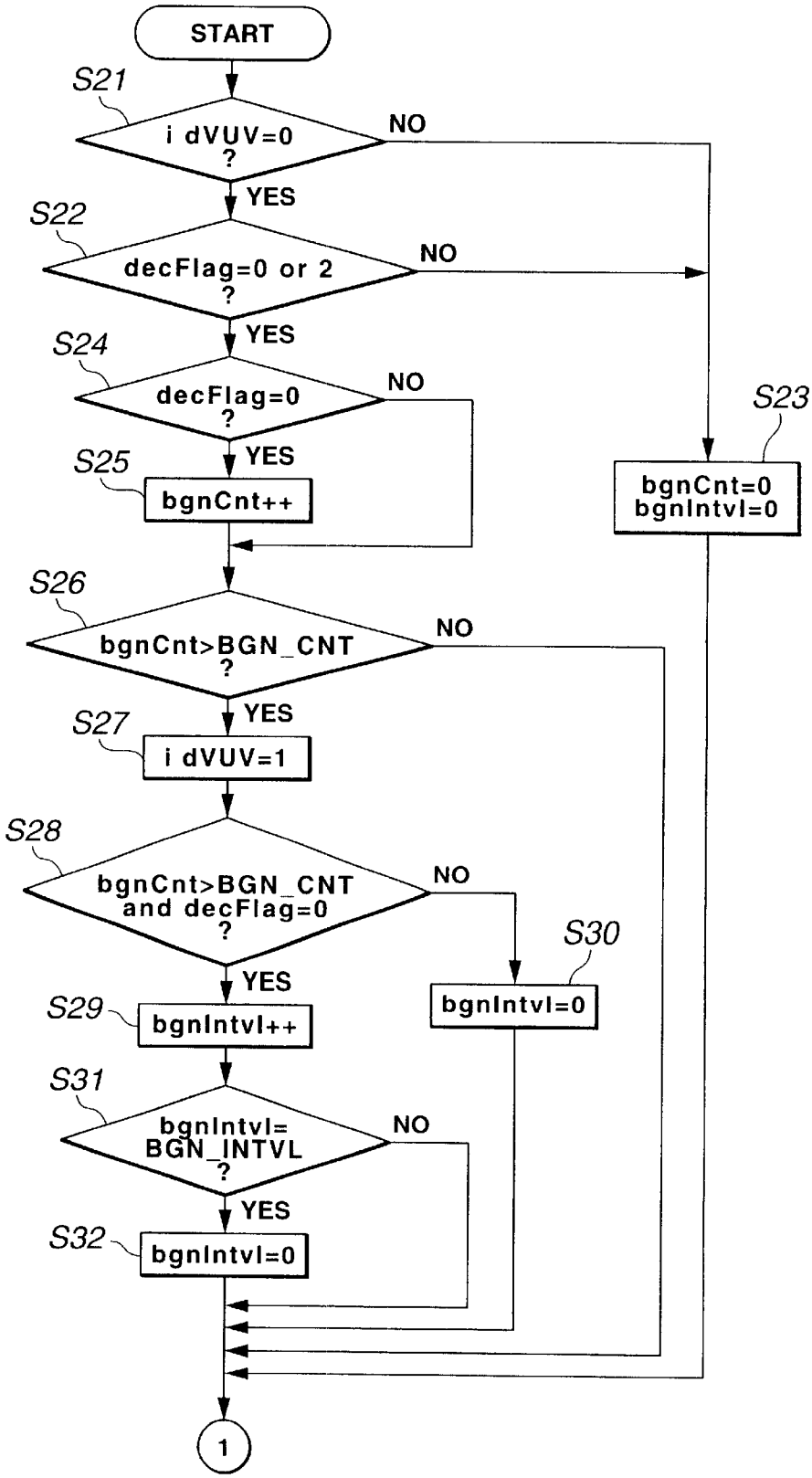
FIG. 10 is a flowchart showing a portion of processing in determining transmission parameters in a parameter generating unit.
Figure 11:
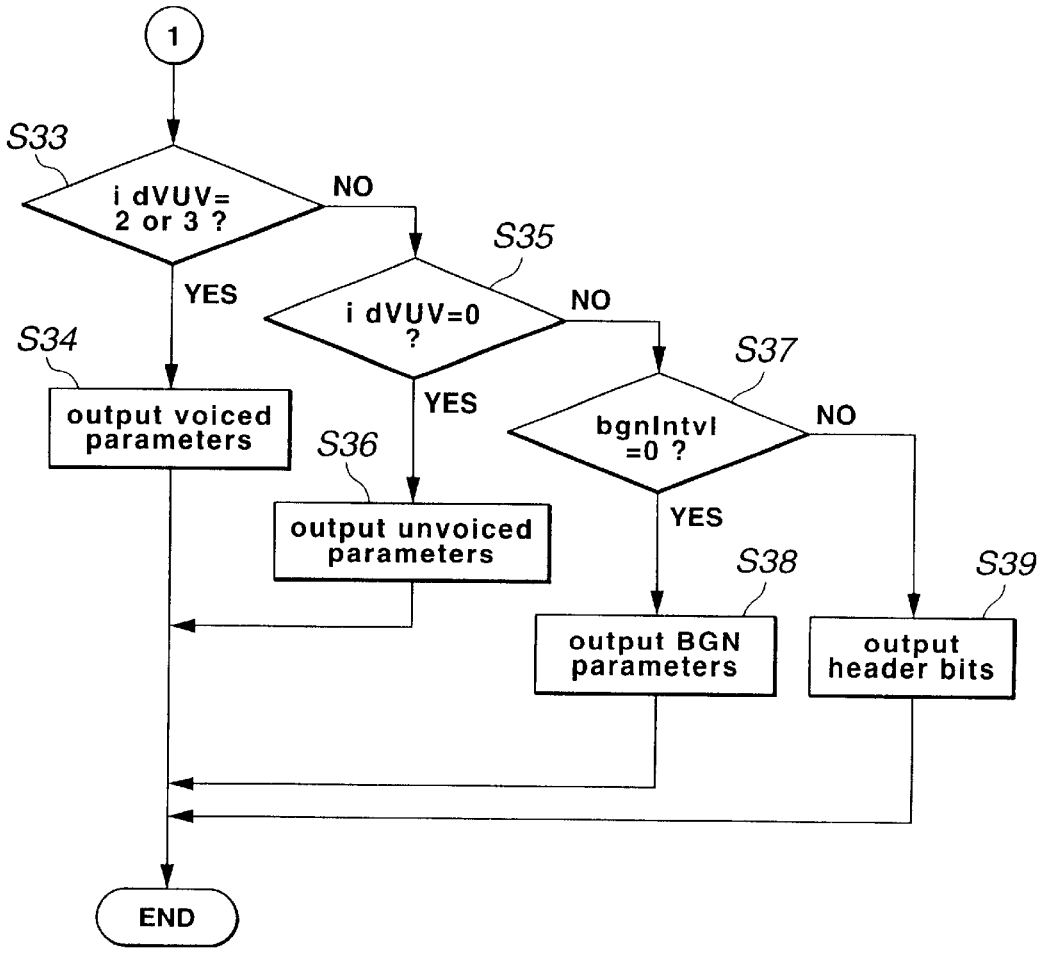
FIG. 11 is a flowchart showing the remaining portion of processing in determining transmission parameters in a parameter generating unit.

The flowchart determining the transmission parameters are shown in FIGS. 10 and 11. The background noise counter bgnCnt and the background noise period counter bgnIntv1, both having an initial value of 0, are defined. First, if the result of analysis of the input signal at step S21 of FIG. 10 indicates the unvoiced sound (idVUV =0), and decFlag=0 through the steps S22 to S24, the program moves to step S25 to increment the background noise counter bgnCnt by 1. If decFlag=2, the bgnCnt is kept. If, at step S26, bgnCnt is not less than a constant BGN_CNT, such as 6, the program moves to step S27 to set the idVUV to the value indicating the background noise or 1. If, at step S28, decFlag=0, with bgnCnt >BGN_CNT, bgnCnt is incremented at step S29 by 1. If at step S31 bgnIntv1 is equal to a constant BGN_INTVL, such as 16, the program moves to step S32 to set bgnlntva1=0. If at step S28 decFlag=2 or bgnCnt=BGN=CNT, the program moves to step S30 where bgnIntv1=0 is set.

If, at step S21, the sound is the voiced (idVUV=2, 3), or if, at step S22, decFlag=1, the program moves to step S23 where bgnCnt=0 and bgnIntv1=0 are set.

Referring to FIG. 11, if at step S33 the sound is unvoiced or the background noise (idVUV=0, 1), and if at step S35 the sound is the unvoiced (idVUV=0), the unvoiced parameter is outputted at step S36.

If at step S35 the background noise (idVUV=1) and if, at step S37, bgnIntv1 =0, the background noise parameter (BGN=background noise) is outputted at step S38. On the other hand, if at step S37 bgnIntv1 >0, the program moves to step S39 to transmit only the header bit.

The configuration of the header bits is shown in FIG. 16. It is noted that idVUV bits are straightly set in the upper two bits. If the background noise period (idVUV=1) and the frame is not the renovation frame, the next 1 bit is set to 0 and, if otherwise, the next bit is set to 1.

Taking the speech codec HVXC (harmonic vector excitation coding), adopted in MPEG4, as an example, the coded bits under respective conditions are shown in detail in FIG. 12.

For voiced, unvoiced, background noise renovation or background noise non-renovation, idVUV is encoded with two bits. As the renovation flag, 1 bit each is allotted at the time of background noise renovation and non-renovation, respectively.

The LSP parameters are divided into LSP0, LSP2, LSP3, LSP4 and LSP 5. Of these, LSP0 is the codebook index of the order-ten LSP parameter and is used as the basic envelope parameter. For a 20 nsec frame, 5 bits are allotted. LSP 2 is a codebook index of the LSP parameter of the order-five low frequency error correction and has 7 bits allotted thereto. The LSP3 is a codebook index of an LSP parameter for order-five high frequency range error correction and has 5 bits allotted thereto. The LSP5 is a codebook index of an LSP parameter for order-ten full frequency range error correction and has 8 bits allotted thereto. Of these, LSP2, LSP3 and LSP5 are indices used for compensating the error of the previous stage and are used supplementarily when the LSP0 has not been able to represent the envelope sufficiently. The LSP4 is a 1-bit selection flag for selecting whether the encoding mode at the time of encoding is the straight mode or the differential mode. Specifically, it indicates the selection between the LSP of the straight mode as found by quantization and the LSP as found from the quantizes difference, whichever has a smaller difference from the original LSP parameter as found on analysis from the original waveform. If the LSP4 is 0 or 1, the mode is the straight mode or the differential mode, respectively.

For a voiced sound, the LSP parameters in their entirety are coded bits. For voiced sound and in background noise renovation, LSP5 are excluded from the coded bits. The LSP code bits are not sent at the time of non-renovation of the background noise. In particular, the LSP code bits at the time of background noise renovation are code bits obtained on quantizing the average values of the LSP parameters of the latest three frames.

The pitch parameters PCH are 7-bit code bits only for the voiced sound. The codebook parameter idS of the spectral codebook is divided into a zeroth LPC residual spectral codebook index idS0 and the first LPC residual spectral codebook index idS 1. For the voiced sound, both indexes are 4 code bits. The noise codebook indexes idSL00, idSL01 are encoded in six bits for an unvoiced sound.

For voiced sound, the LPC residual spectral gain codebook index idG is set to 5-bit code bots. For unvoiced sound, 4 bits of code bits are allotted to each of the noise codebook gain index idGL00 and idGL11. For background noise renovation, only 4 bit code bits are allotted to idGL00. These 4 bits of idGL00 in background noise renovation are code bits obtained on quantizing the average value of the CELP gain of the latest four frames (eight sub-frames).

For voiced sound, 7, 10, 9 and 6bits are allotted as code bits to the zeroth extension LPC residual spectral codebook index, indicated as idS0_4k, first extension LPC residual spectral codebook index, indicated as idS1_4k, second extension LPC residual spectral codebook index, indicated as idS2_4k and to the third extension LPC residual spectral codebook index, indicated as idS3_4k, respectively.

This allots 80 bits for,voiced sound, 40 bits for unvoiced sound, 25 bits for background noise renovation and 3 bits for background noise non-renovation, respectively.

Referring to FIG. 2, the speech encoder for generating code bits shown in FIG. 12 is explained in detail.

The speech signal supplied to the input terminal 101 is filtered by a high-pass filter (HPF) 109 to remove signals of an unneeded frequency range. The filtered output is sent to the input signal discriminating unit 21*a*, as described above, and to an LPC analysis circuit 132 of an LPC (linear prediction coding) analysis quantization unit 113 and to an LPC back-filtering circuit 111.

The LPC analysis circuit 132 of the LPC analysis quantization unit 113 applies the Hamming window, with a length of the input signal waveform on the order of 256 samples as a block, to find linear prediction coefficients by an autocorrelation method, that is a so-called α-parameter. The framing interval as a data outputting unit is on the order of 160 samples. With the sampling frequency fs of, for example, 8 kHz, the frame interval is 160 samples or 20 msec.

The α-parameter from the LPC analysis circuit 132 is sent to an α-LSP conversion circuit 133 for conversion to a line spectrum pair (LSP) parameter. In this case, the (x-parameter, found as a straight filter coefficient, is converted into e.g., ten, that is five pairs, of LSP parameters by e.g., the Newton-Rhapson method. This conversion to the LSP parameters is used because the LSP parameters are superior to the α-parameters in interpolation characteristics.

The LSP parameters from the α-LSP conversion circuit 133 are matrix- or vector-quantizes by an LSP quantizer 134. The frame-to-frame difference may be taken first prior to vector quantization. Alternatively, several frames may be taken together and quantizes by matrix quantization. Here, 20 msec is one frame and LSP parameters calculated every 20 msec are taken together and subjected to matrix or vector quantization.

A quantizes output of an LSP quantizer 134, that is the index of LSP quantization, is taken out at a terminal 102, while the quantizes LSP vector is sent to an LSP interpolation circuit 136.

The LSP interpolation circuit 136 interpolates the LSP vector, quantizes every 20 msec or every 40 msec, to raise the rate by a factor of eight, so that the LSP vector will be renovated every 2.5 msec. The reason is that, if the residual waveform is analysis-synthesized by the harmonic encoding/decoding method, the envelope of the synthesized waveform is extremely smooth, such that, if the LPC coefficients are changed extremely rapidly, extraneous sounds tend to be produced. That is, if the LPC coefficients are changed only gradually every 2.5 msec, such extraneous sound can be prevented for being produced.

For executing the back-filtering of the input speech using the interpolated 2.5 msec-based LSP vector, the LSP parameter is converted by an LSP-to-α conversion circuit 137 into an α-parameter which is a coefficient of a straight type filter with the number of orders approximately equal to ten. An output of the LSP-to-α conversion circuit 137 is sent to the LPC back-filtering circuit 111 where back-filtering is carried out with the α-parameter renovated every 2.5 msec to realize a smooth output. An output of the LPC back-filtering circuit 111 is sent to an orthogonal conversion circuit 145, such as a discrete Fourier transform circuit, of the sinusoidal analysis encoding unit 114, specifically, a harmonic encoding circuit.

The α-parameter from the LPC analysis circuit 132 of the LPC analysis quantization unit 113 is sent to a psychoacoustic weighting filter calculating circuit 139 where data for psychoacoustic weighting is found. This weighted data is sent to the psychoacoustically weighted vector quantization unit 116, psychoacoustic weighting filter 125 of the second encoding unit 120 and to the psychoacoustically weighted synthesis filter 122.

The sinusoidal analysis encoding unit 114, such as the harmonic encoding circuit, an output of the LPC back-filtering circuit 111 is analyzed by a harmonic encoding method. That is, the sinusoidal analysis encoding unit detects the pitch, calculates the amplitude Am of each harmonics and performs V/UV discrimination. The sinusoidal analysis encoding unit also dimensionally converts the number of the amplitudes Am or the envelope of harmonics changed with the pitch into a constant number.

In a specified example of the sinusoidal analysis encoding unit 114 shown in FIG. 2, routine harmonic encoding is presupposed. In particular, in multi-band excitation (MBE) encoding, modeling is made on the assumption that a voiced portion and an unvoiced portion are present in each frequency range or band at a concurrent time, that is in the same block or frame. In other forms of harmonic coding, an alternative decision is made as to whether the speech in a block or frame is voiced or unvoiced. In the following explanation, V/UV on the frame basis means the V/UV of a given frame when the entire band is UV in case the MBE coding is applied. As for the synthesis by analysis method of MBE, the Japanese Laying-Open Patent H-5-265487, proposed by the present Assignee, discloses a specific example.

An open-loop pitch search unit 141 of the sinusoidal analysis encoding unit 114 of FIG. 2 is fed with an input speech signal from the input terminal 101, while a zero-crossing counter 142 is fed with a signal from a high-pass filter (HPF) 109. The orthogonal conversion circuit 145 of the sinusoidal analysis encoding unit 114 is fed with LPC residuals or linear prediction residuals from the LPC back-filtering circuit 111. The open-loop pitch search unit 141 takes the LPC residuals of the input signal to perform relatively rough pitch search by taking LPC residuals of the input signal. The extracted rough pitch data is sent to a high-precision pitch search unit 146 where high-precision pitch search by the closed loop (fine pitch search), as later explained, is performed. From the open-loop pitch search unit 141, the maximum normalized autocorrelation value r(p), obtained on normalizing the maximum value of the autocorrelation of the LPC residuals, are taken out along with the rough pitch data, and sent to the V/UV decision unit 115.

The orthogonal conversion circuit 145 performs orthogonal transform processing, such as discrete cosine transform (DFT), to transform LPC residuals on the time axis into spectral amplitude data on the frequency axis. An output of the orthogonal conversion circuit 145 is sent to the high-precision pitch search unit 146 and to a spectrum evaluation unit 148 for evaluating the spectral amplitude or envelope.

The high-precision pitch search unit 146 is fed with a rough pitch data of a relatively rough pitch extracted by the open-loop pitch search unit 141 and data on the frequency interval extracted by the open-loop pitch search unit 141. In this high-precision pitch search unit 146, pitch data are swung by ±several samples, with the rough pitch data value as center, to approach to values of fine pitch data having an optimum decimal point (floating). As the fine search technique, the so-called analysis by synthesis method is used and the pitch is selected so that the synthesized power spectrum will be closest to the power spectrum of the original speech. The pitch data from the high-precision pitch search unit 146 by the closed loop is sent through switch 118 to the output terminal 104.

In the spectrum evaluation unit 148, the magnitude of each harmonics and a spectral envelope as its set are evaluated, based on the pitch and the spectral amplitudes as an orthogonal transform output of the LPC residuals. The result of the evaluation is sent to the high-precision pitch search unit 146, V/UV decision unit 115 and to the psychoacoustically weighted vector quantization unit 116.

In the V/UV decision unit 115, V/UV decision of a frame in question is given based on an output of the orthogonal conversion circuit 145, an optimum pitch from the high-precision pitch search unit 146, amplitude data from the spectrum evaluation unit 148, maximum normalized autocorrelation value r(p) from the open-loop pitch search unit 141 and the value of zero crossings from the zero-crossing counter 142. The boundary position of the result of the band-based V/UV decision in case of MBE coding may also be used as a condition of the V/UV decision of the frame in question. A decision output of the V/UV decision unit 115 is taken out via output terminal 105.

An output of the spectrum evaluation unit 148 or an input of the vector quantization unit 116 is provided with a number of data conversion unit 119, which is a sort of a sampling rate conversion unit. This number of data conversion unit operates for setting the amplitude data $|A_m|$ of the envelope to a constant number in consideration that the number of bands split on the frequency interval is varied with the pitch and hence the number of data is varied. That is, if the effective band is up to 3400 kHz, this effective band is split into 8 to 63 bands, depending on the pitch, such that the number $m_{Mx}+1$ of the amplitude $|A_m|$ data obtained from band to band also is varied in a range from 8 to 63. So, the number of data conversion unit 119 converts this variable number $m_{MX}+1$ amplitude data into a constant number M, for example, 44.

The above-mentioned constant number M, such as 44, amplitude data or envelope data from the number of data conversion unit provided at an output of the spectrum evaluation unit 148 or at an input of the vector quantization unit 116 are collected in terms of a pre-set number of data, such as 44 data, as vectors, which are subjected to weighted vector quantization. This weighting is imparted by an output of the psychoacoustic weighting filter calculating circuit 139. An index idS of the above-mentioned envelope from the vector quantization unit 116 is outputted at the output terminal 103 through switch 117. Meanwhile, an inter-frame difference employing an appropriate leakage coefficient may be taken for a vector made up of a pre-set number of data prior to the weighted vector quantization.

The encoding unit having the so-called CELP (coded excitation linear prediction) encoding configuration is hereinafter explained. This encoding unit is used for encoding the unvoiced portion of the input speech signal. In this CELP encoding configuration for the unvoiced speech portion of the input speech signal, a noise output corresponding to LPC residuals of the unvoiced speech as a representative output of the noise codebook, or a so-called stochastic codebook 121, is sent through a gain circuit 126 to the psychoacoustically weighted synthesis filter 122. The weighted synthesis filter 122 LPC-synthesizes the input noise by LPC synthesis to send the resulting signal of the weighted unvoiced speech to a subtractor 123. The subtractor is fed with speech signals supplied from the input terminal 101 via a high-pass filter (HPF) 109 and which has been psychoacoustically weighted by a psychoacoustically weighting filter 125. Thus, the.subtractor takes out a difference or error from a signal from the synthesis filter 122. It is noted that a zero input response of the psychoacoustically weighting synthesis filter is to be subtracted at the outset from an output of the psychoacoustically weighting filter 125. This error is sent to a distance calculating circuit 124 to make distance calculations to search a representative value vector which miniminizes the error by the noise codebook 121. It is the time interval waveform, which is obtained by employing the closed loop search, employing in turn the analysis by synthesis method, that is vector quantizes.

As data for UV (unvoiced) portion from the encoding unit employing the CELP encoding configuration, the shape index idSI of the codebook from the noise codebook 121 and the gain index idGI of the codebook from a gain circuit 126 are taken out. The shape index idSI, which is the UV data from the noise codebook 121, is sent through a switch 127*s* to an output terminal 107*s*, whilst the gain index idGI, which is the UV data of the gain circuit 126, is sent via switch 127*g* to an output terminal 107*g*.

These switches 127*s*, 127*g* and the above-mentioned switches 117, 118 are on/off controlled based on the results of V/UV discrimination from the V/UV decision unit 115. The switches 117, 118 are turned on when the results of V/UV decision of the speech signals of the frame now about to be transmitted indicate voiced sound (V), whilst the switches 127*s*, 127*g* are turned on when the speech signals of the frame now about to be transmitted are unvoiced sound (UV).

The respective parameters, encoded with the variable rate, by the above-described speech encoder, that is the LSP parameters LSP, voiced/unvoiced discrimination parameter idVUV, pitch parameter PCH, codebook parameter idS and the gain index idG of the spectral envelope, noise codebook parameter idS1 and the gain index idG1, are encoded by a transmission path encoder 22 so that the speech quality will not be affected by the quality of the transmission path. The resulting signals are modulated by a modulator 23 and processed for transmission by a transmitter 24 so as to be transmitted through an antenna co-user 25 over an antenna 26. The above parameters are also sent to the parameter generating unit 12 of the parameter controlling unit 21*b*, as discussed above. The parameter generating unit 12 generates idVUV and an 0 renovated flag, using the result of discrimination idVUV from the V/UV decision unit 115, the above parameter and bgnIntv1 from the counter controller 11. The parameter controlling unit 21*b* also manages control so that, if idVUV=1 indicating the background noise is sent from the V/UV decision unit 115, the differential mode (LSP4=1) as the LSP quantization method is inhibited for the LSP quantizer 134 to cause the quantization to be performed by the straight mode (LSP4=0).

The speech decoding device 31 on the receiving side of the portable telephone device shown in FIG. 1 is explained. The speech decoding device 31 is fed with reception bits captured by an antenna 26, received by a receiver 27 over the antenna co-user 25, demodulated by the demodulator 29 and corrected by the transmission path decoder 30 for transmission path errors.

Figure 13:
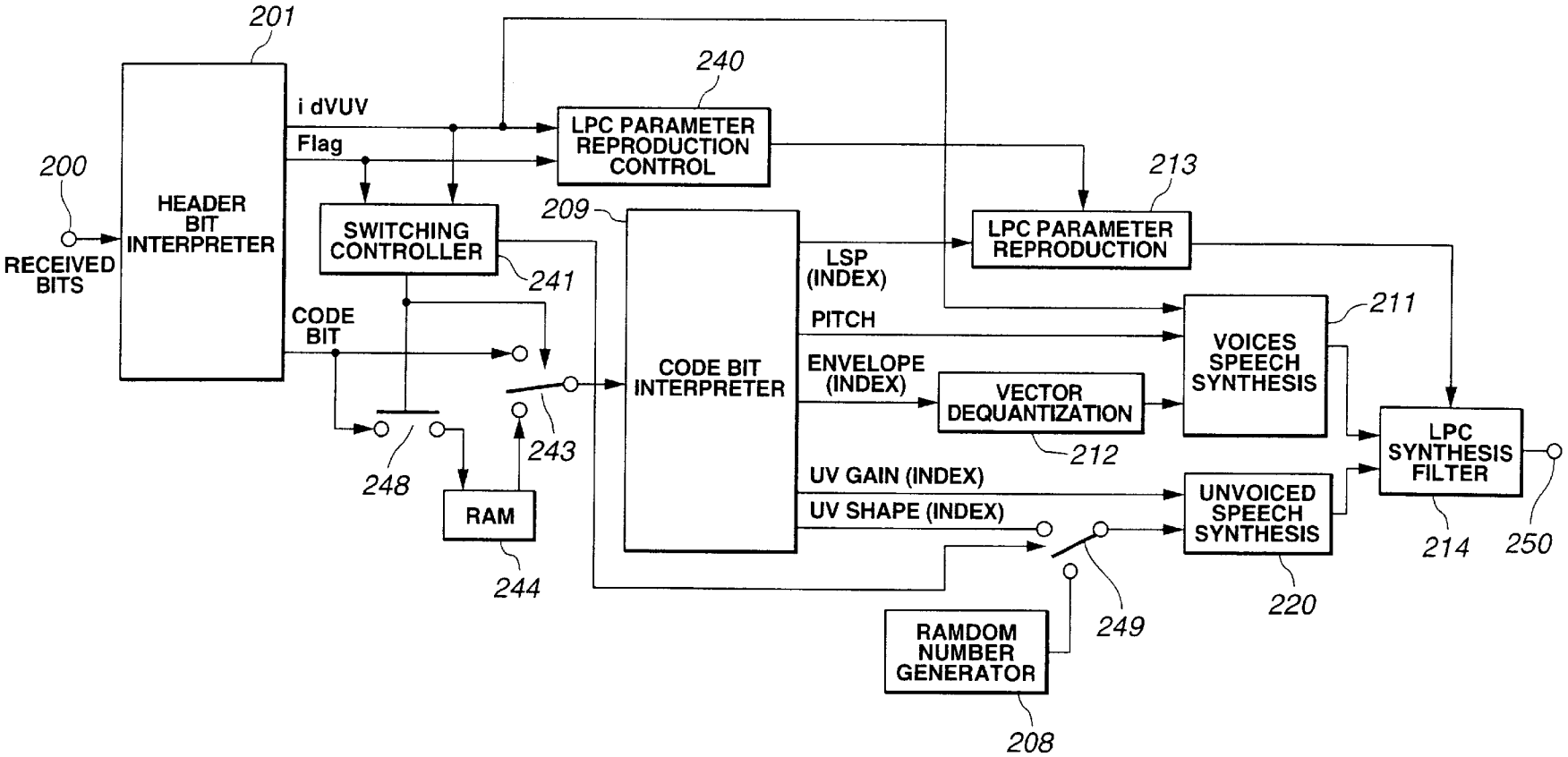
FIG. 13 is a block diagram showing a detailed structure of the speech decoding apparatus.

The structure of the speech decoding device 31 is shown in detail in FIG. 13. Specifically, the speech decoding device includes a header bit interpreting unit 201 for taking out header bit from the reception bit inputted at an input terminal 200 to separate idVUV and the renovation flag in accordance with FIG. 16 and for outputting code bits, and a switching controller 241 for controlling the switching of the switches 143, 248, as later explained, by the idVUV and the renovation flag. The speech decoding device also includes an LPC parameter reproduced controller 240 for determining the LPC parameters or LSP parameters by a sequence as later explained, and an LPC parameter reproducing unit 213 for reproducing the LPC parameters from the LSP indexes in the code bits. The speech decoding device also includes a code bit interpreting unit 209 for resolving the code bits into individual parameter indexes and a switch 248, controlled by the switching controller 241 so that it is closed on reception of the background noise renovation frame and is opened if otherwise. The speech decoding device also includes a switch 243 controlled by the switching controller 241 so that it is opened towards a RAM 244 on reception of the background noise renovation frame and is opened if otherwise, and a random number generator 208 for generating the UV shape index as random numbers. The speech decoding device also includes a vector dequantizer 212 for vector dequantizing the envelope from the envelope index and a voiced speech synthesis unit 211 for synthesizing the voiced sound from the idVUV, pitch and the envelope. The speech decoding device also includes an LPC synthesis filter 214 and the RAM 244 for holding code bits on reception of the background noise renovation flag and for furnishing the code bits on reception of the background noise non-renovation flag.

First, the header bit interpreting unit 201 takes out the header bit from the reception bits supplied from the input terminal 200 to separate the idVUV from the renovation flag Flag to recognize the number of frames in a frame in question. If there is a next following bit, the header bit interpreting unit 201 outputs it as a code bit. If the upper two bits of the header bit configuration are 00, the bits are seen to be the background noise (BGN), so that, if the next one bit is 0, the frame is the non-renovation frame ,so that the processing comes to a close. If the next bit is 1, the next 22 bits are read out to read out the renovation frame of the background noise. If the upper two bits are 10/11, the frame is seen to be voiced so that the next 78 bits are read out.

The switching controller 241 checks the idVUV and the renovation flag. If idVUV=1, and the renovation flag Flag=1, the renovation is to occur, so that the switch 248 is closed to send the code bit to the RAM 244. Simultaneously, the switch 243 is closed to the side of the header bit interpreting unit 201 to send the code bit to the code bit interpreting unit 209. If conversely the renovation flag Flag=0, the renovation is not to occur so that the switch 248 is opened. The switch 243 is closed to the side of the RAM 244 to supply the code bit at the time of renovation. If idVUV≠1, the switch 248 is opened whilst the switch 243 is opened towards an upper side.

The code bit interpreting unit 209 resolves the code bits supplied thereto from the header bit interpreting unit 201 through the switch 243 into respective parameter indexes, that is LSP indexes, pitch, envelope indexes, UV gain indexes or UV shape indexes.

The random number generator 208 generates the UV shape index as random numbers. If the switch 249 receives the background noise frame with idVUV=1, the switch 249 is closed by the switching controller 241 to send the UV shape index to the unvoiced sound synthesis unit 220. If If idVUV≠1, the UV shape index is sent through the switch 249 from the code bit interpreting unit 209 to the unvoiced sound synthesis unit 220.

The LPC parameter reproduced controller 240 internally has a switching controller and an index decision unit and detects the idVUV by the switching controller to control the operation of the LPC parameter reproducing unit 213 based on the results of detection, in a manner which will be explained subsequently.

Figure 14:
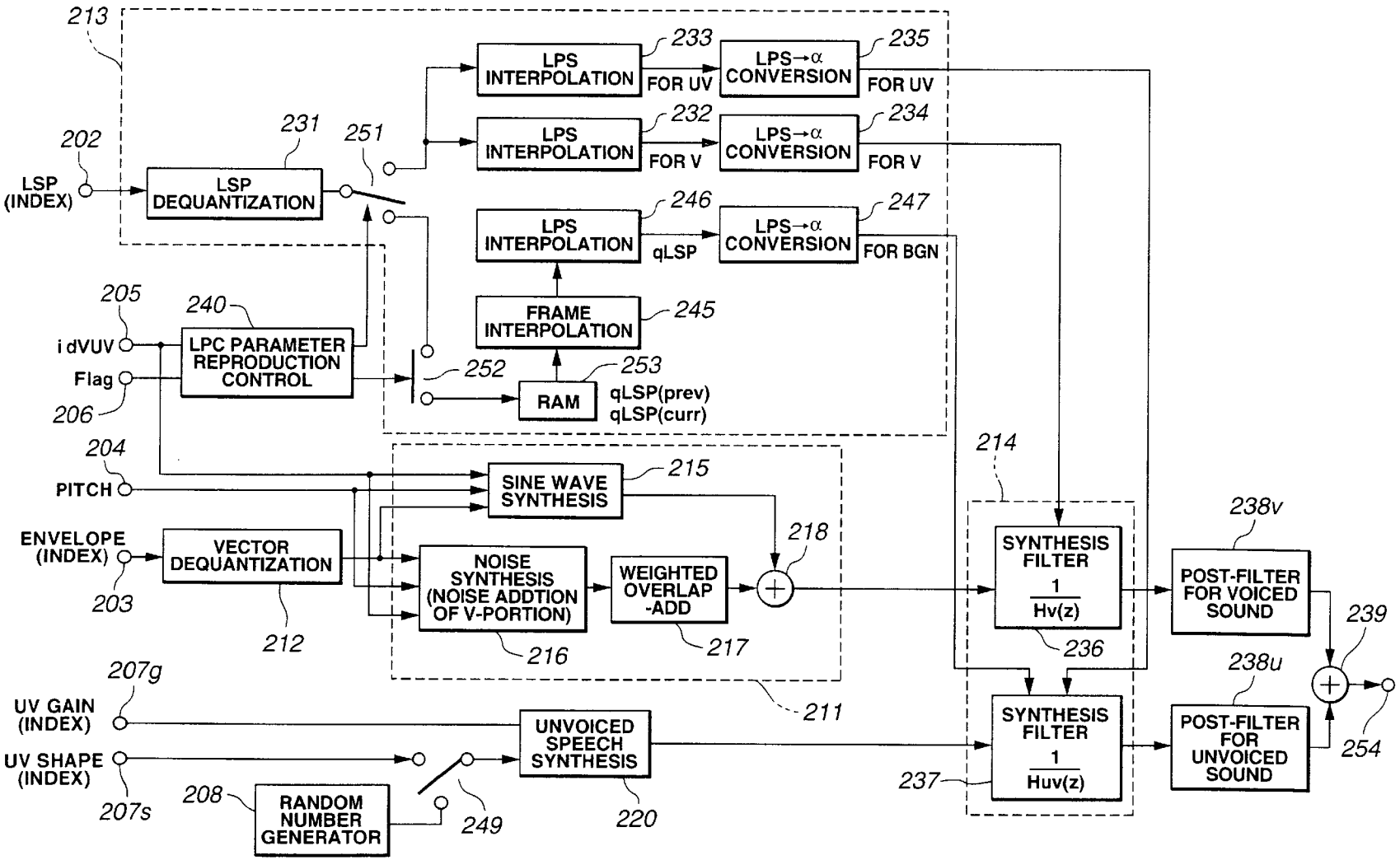
FIG. 14 is a block diagram showing the structure of basic and ambient portions of the speech encoding device.

The LPC parameter reproducing unit 213, unvoiced sound synthesis unit 220, vector dequantizer 212, voiced sound synthesis unit 211 and the LPC synthesis filter 214 make up the basic portions of the speech decoding device 31. FIG. 14 shows the structure of these basic portions and the peripheral portions.

The input terminal 202 is fed with the vector quantizes output of the LSP, that is the so-called codebook index.

This LSP index is sent to the LPC parameter reproducing unit 213. The LPC parameter reproducing unit 213 reproduces LPC parameters by the LSP index in the code bit, as described above. The LPC parameter reproducing unit 213 is controlled by a switching controller in the LPC parameter reproduced controller 240, not shown.

First, the LPC parameter reproducing unit 213 is explained. The LPC parameter reproducing unit 213 includes an LSP dequantizer 231, a change over switch 251, LSP interpolation circuits 232 (for V) and 233 (for UV), LSP→α a conversion circuits 234 (for V) and 235 (for UV), a switch 252, a RAM 253, a frame interpolation circuit 245, an LSP interpolation circuit 246 (for BGN) and an LSP→α a conversion circuit 247 (for BGN).

The LSP deqantizer 231 dequantizes the LSP parameter from the LSP index. The generation of the LSP parameter in the LSP dequantizer 231 is explained. Here, a background noise counter bgnIntv1 (initial value=0) is introduced. In case of the voiced sound (idVUV=2, 3) or an unvoiced sound (idVUV=0), LSP parameters are generated by usual decoding processing.

In case of the background noise (idVUV=1), if the frame is the renovation frame, bgnIntv1=0 is set and, if otherwise, bgnIntv1 is incremented by one. If, when bgnIntv1 is incremented by one, it is equal to the constant BGN_INTVL_RX as later explained, bgnIntv1 is not incremented by one.

Then, LSP parameters are generated, as in the following equation (20):

$$qLSP(i) = \frac{(2\cdot(\mathrm{BGN_INTVL_RX} - bgnIntval') - 1)\cdot qLSP_{(prev)}(i) + (2\cdot bgnIntval' + 1)\cdot qLSP_{(curr)}(i)}{2\cdot \mathrm{BGN_INTVL_RX}} \quad (20)$$

it being noted that the LSP parameter received directly before the renovating frame is qLSP (prev)(1, . . . , 10), the LSP parameter received in the renovation frame is qLSP (curr)(1, . . . , 10) and the LSP parameter generated by interpolation is qLSP(l, . . . , 10).

In the above equation, BGN_INTVL_RX is a constant, and bgnIntv1' is generated, using bgnIntv1 and a random number rnd (=−3, . . . , 3), by the following equation (21):

$$\mathrm{bgnIntv1'=bgnIntv1+rnd} \quad (21)$$

it being noted that, if, when bgnIntv1'<0, bgnIntv1'=bgnIntv1 and bgnIntv1'≧BGN_INTVL_RX, bgnIntv1'=bgnIntv1 is set.

A switching controller, not shown, in the LPC parameter reproducing controller 240, controls switches 252, 262 in the inside of the LPC parameter reproducing unit 213, based on the V/UV parameter idVUV and the renovation flag Flag.

For idVUV=0, 2, 3 and for idVUV=1, the switch 251 is set to an upper terminal and to a lower terminal, respectively.

If the renovation flag Flag=1, that is in case of the background noise renovation frame, the switch 252 is closed to send the LSP parameter to the RAM 253 to renovate the qLSP(curr) after qLSP(prev) is renovated by qLSP(curr). The RAM 253 holds qLSP(prev) and qLSP(curr).

A frame interpolation circuit 245 generates qLSP using an internal counter bgnIntv1 from qLSP(curr) and qLSP(prev). An LSP interpolation circuit 246 interpolates the LSPs. An LSP→α converting circuit 247 converts LSP for BGN to α.

Figure 15:
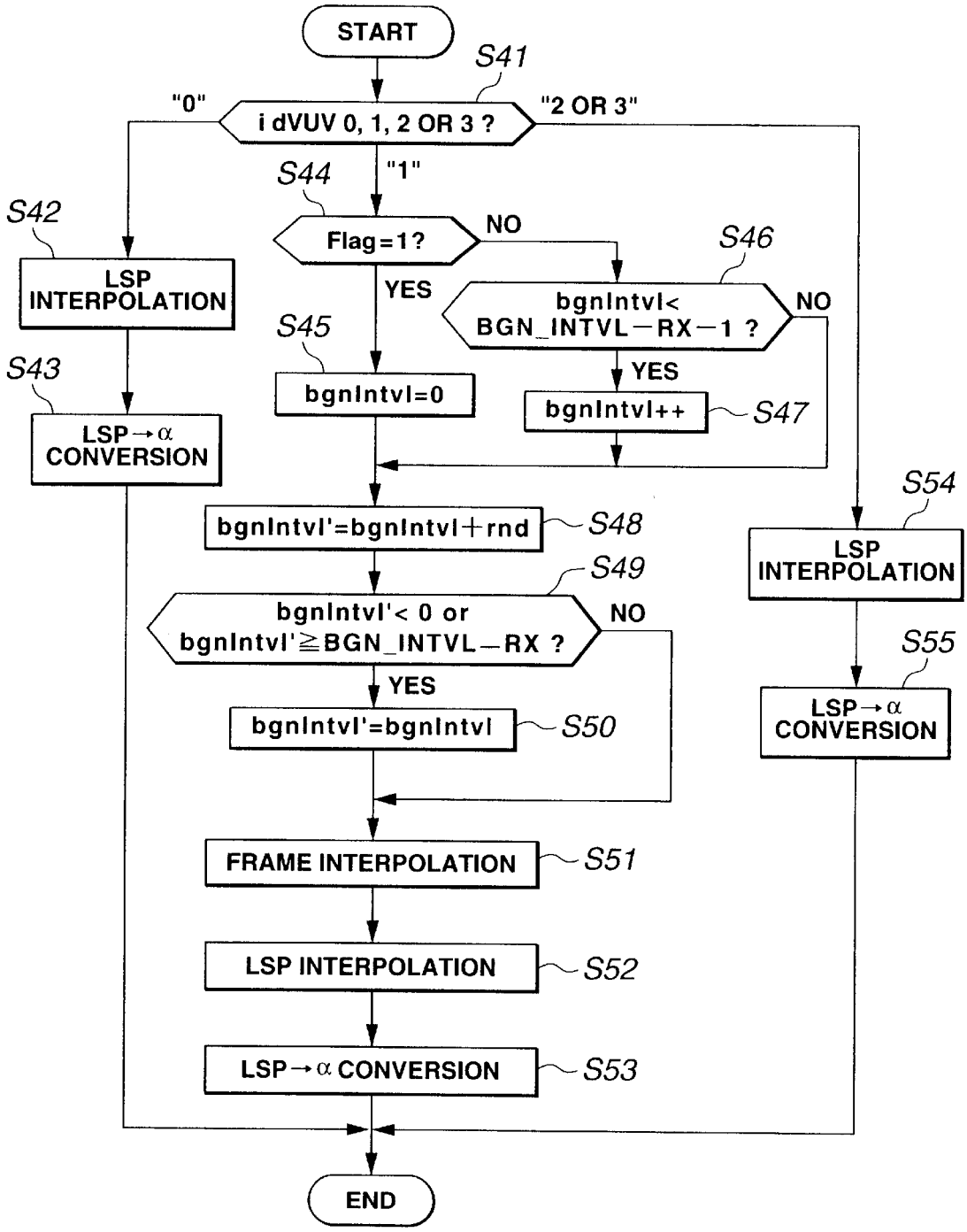
FIG. 15 is a flowchart showing details of an LPC parameter reproducing portion by an LPC parameter reproducing controlling unit.

The control of the LPC parameter reproducing unit 213 by the LPC parameter reproducing controller 240 is explained in detail by referring to the flowchart of FIG. 15.

First, a switching controller of the LPC parameter reproducing controller 240 at step S41 detects a V/UV decision parameter idVUV. If the parameter is 0, the switching controller transfers to step S42 to interpolate the LSPs by an LSP interpolation circuit 233. The switching controller then transfers to step S43 where LSPs are converted to α by the LSP→0 converting circuit 235.

If idVUV=1 at step S41 and the renovation flag Flag=1 at step S44, the frame is the renovation frame, so that bgnIntv10 is set at step S45 in the frame interpolation circuit 245.

If the renovation flag Flag=0 at step S44, and bgnIntv1<BGN_INTVL_RX−1, the switching controller transfers to step S47 to increment bgnIntv1 by one.

At step S48, bgnIntv1' is generated as random number rnd by the frame interpolation circuit 245. However, if bgnIntv1'<0 or if bgnIntv1'≧BGN_INTVL_RX, bgnIntv1'= bgnIntv1 is set at step S50.

Then, at step S51, the LSPs are frame-interpolated by the frame interpolation circuit 245. At step S52, the LSPs are interpolated by an interpolation circuit 246 and, at step S53, LSPs are converted to α by an LSP→α converting circuit 247.

If idVUV=2, 3 at step S41, the switching controller transfers to step S54 where LSPs are interpolated by the LSP interpolation circuit 232. At step S55, the LSPs are converted to α by the LSP→α conversion circuits 234.

The LPC synthesis filter 214 separates an LPC synthesis filter 236 for the voiced portion and an LPC synthesis filter 237 of the unvoiced portion. That is, the LPC coefficient interpolation is performed independently in the voiced and unvoiced portions to prevent adverse effects that might be produced by interpolating LSPs of totally different properties at a transition from the voiced to the unvoiced portions or from the unvoiced to the voiced portions.

The input terminal 203 is fed with code index data corresponding to the weighted vector quantizes spectral envelope Am. The input terminals 204, 205 are fed with data of the pitch parameter PCH and with the above-mentioned V/UV decision data idVUV, respectively.

The index data corresponding to the weighted vector quantizes spectral envelope Am from the input terminal 203 is sent to the vector dequantizer 212 for vector dequantization. Thus, the data is back-converted in a manner corresponding to the data number conversion and proves spectral envelope data which is sent to the sinusoidal synthesis circuit 215 of the voiced sound synthesis unit 211.

If a frame-to-frame difference is taken prior to vector dequantization of the spectrum in encoding, the decoding of frame-to-frame difference is performed after the vector dequantization, followed by data number conversion, to produce spectral envelope data.

The sinusoidal synthesis circuit 215 is fed with the pitch from the input terminal 204 and with the V/UV decision data idVUV from the input terminal 205. From the sinusoidal synthesis circuit 215, LPC residual data, corresponding to the output of the LPC back-filter 111 of FIG. 2, are taken out and sent to an adder 218. The particular technique of this sinusoidal synthesis is disclosed in Japanese Patent Application H-4-91422 or Japanese Patent Application H-6-198451 filed in the name of the present Assignee.

The envelope data from the vector dequantizer 212, the pitch and V/UV decision data from the input terminals 204, 205 and the V/UV decision data idVUV are routed to a noise synthesis circuit 216 adapted for adding the noise of the voiced (V) portion. An output of the noise synthesis circuit 216 is sent to the adder 218 via a weighted weight addition circuit 217. The reason for doing this is that, since excitation which proves an input to the LPC filter of the voiced sound by sinusoidal synthesis gives a stuffed feeling in the low-pitch sound such as the male voice and the sound quality is suddenly changed between the voiced (V) and the unvoiced (UV) sound to give an unnatural feeling, the noise which takes into account the parameters derived from the encoded speech data, such as pitch, spectral envelope amplitude, maximum amplitude in a frame or the level of the residual signal is added to the voiced portion of the LPC residual signals.

The sum output of the adder 218 is sent to a synthesis filter 236 for voiced speech of the LPC synthesis filter 214 to undergo LPC synthesis processing to produce a time interval waveform signal, which then is filtered by a post filter for voiced speech 238*v* and thence is routed to an adder 239.

The shape index and the gain index, as UV data, are routed respectively to input terminals 207*s* and 207*g*, as shown in FIG. 24. The gain index is then supplied to the unvoiced sound synthesis unit 220. The shape index from the terminal 207*s* is sent to a fixed terminal of a change over switch 249, the other fixed terminal of which is fed with an output of the random number generator 208. If the background noise frame is received, the switch 249 is closed to the side of the random number generator 208, under control by the switching controller 241 shown in FIG. 13. The unvoiced sound synthesis unit 220 is fed with the shape index from the random number generator 208. If idVUV≠1, the shape index is supplied from the code bit interpreting unit 209 through the switch 249.

That is, an excitation signal is generated by routine decoding processing in case of the voiced sound (idVUV=2, 3) or the unvoiced sound (idVUV=0). In case of the background noise (idVUV=1), the shape indexes of CELP idSL00, idSL01 are generated as random numbers rnd (=0, . . . , N_SHAPE=LO-1, where N_SHAPE=LO-1 is the number of the CELP shape code vectors. The CELP gain indexes idGL00, idGL01 are applied to both sub-frames in the renovation frame.

The portable telephone device having the encoding method and device and the decoding method and device embodying the present invention has been explained above. However, the present invention is not limited to an encoding device and a decoding device of the portable telephone device but is applicable to e.g., a transmission system.

Figure 17:
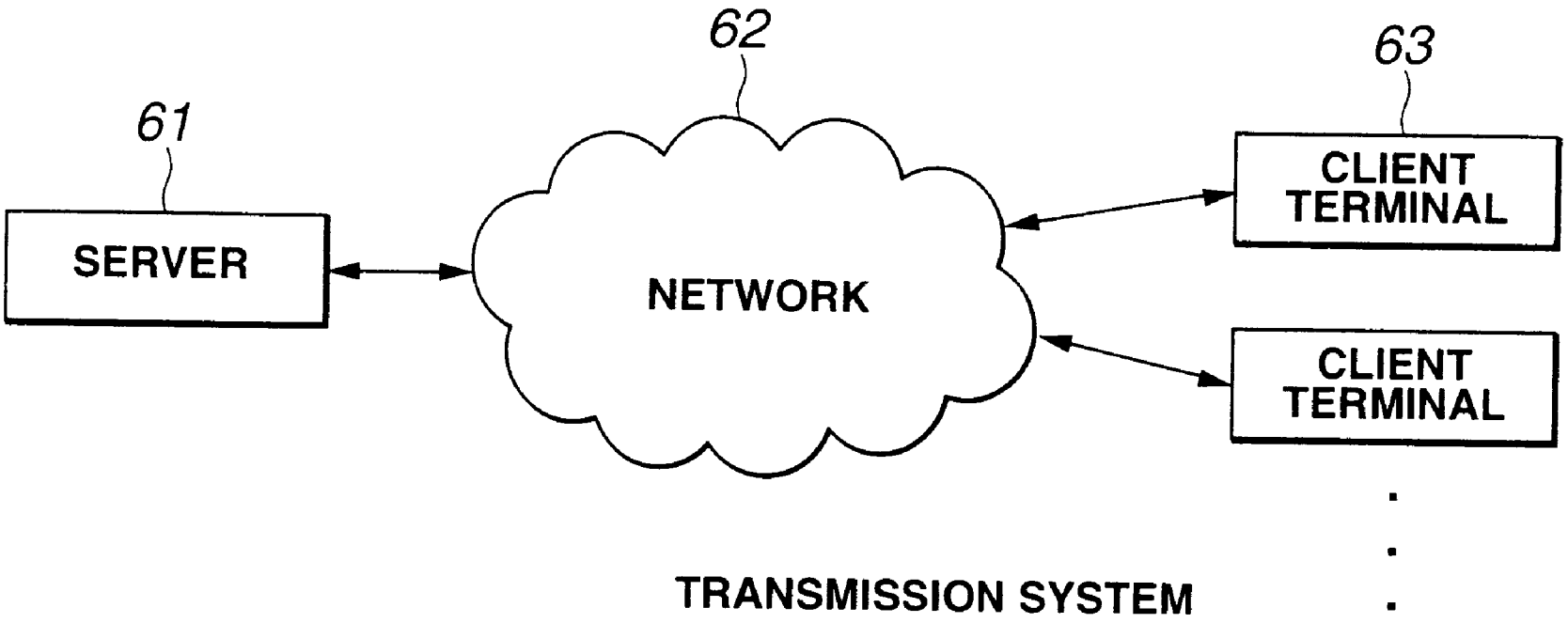
FIG. 17 is a block diagram showing a transmission system to which the present invention can be applied.

FIG. 17 shows an illustrative structure of an embodiment of a transmission system embodying the present invention. Meanwhile, the system means a logical assembly of plural devices, without regard to whether or not the respective devices are in the same casing.

In this transmission system, the decoding device is owned by a client terminal 63, whilst the encoding device is owned by a server 61. The client terminal 63 and the server 61 are interconnected over a network 62, e.g., the Internet, ISDN (Integrated Service Digital Network), LAN (Local Area Network) or PSTN (Public Switched Telephone Network).

If a request for audio signals, such as musical numbers, is made from the client terminal 63 to the server 1 over the network 62, the encoded parameters of audio signals corresponding to requested musical numbers are protected responsive to psychoacoustic sensitivity of bits against transmission path errors on the network 62 and transmitted to the client terminal 63, which then decodes the encoded parameters protected against the transmission path errors from the server 61 responsive to the decoding method to output the decoded signal as speech from an output device, such as a speaker.

Figure 18:
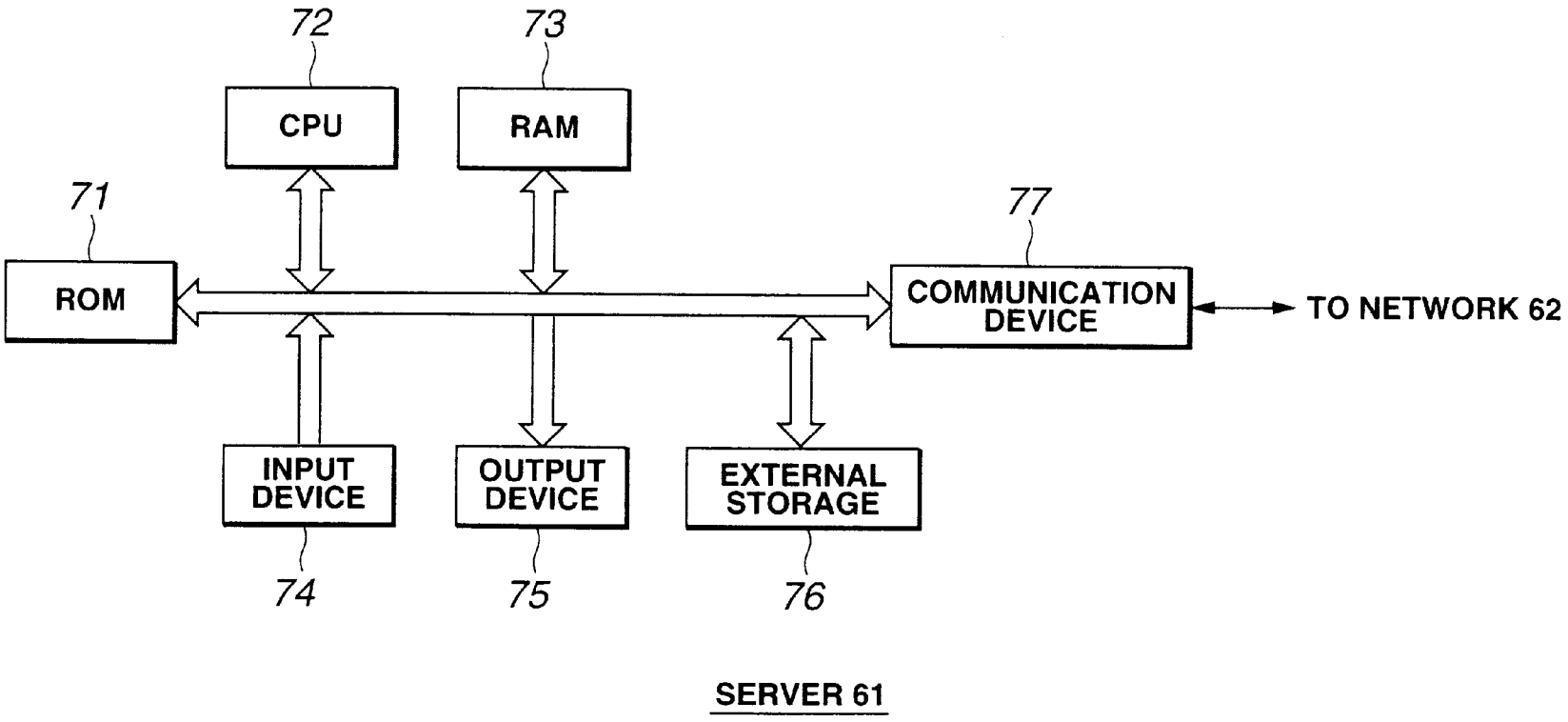
FIG. 18 is a block diagram of a server constituting the transmission system.

FIG. 18 shows an illustrative hardware structure of a server 61 of FIG. 17.

A ROM (read-only memory) 71 has stored therein e.g., IPL (Initial Program Loading) program. The CPU (central processing unit) 72 executes an OS (operating system) program, in accordance with the IPL program stored in the ROM 71. Under the OS control, a pre-set application program stored in an external storage device 76 is executed to protect the encoding processing of audio signals and encoding obtained on encoding to perform transmission processing of the encoding data to the client terminal 63. A RAM (random access memory) 73 memorizes programs or data required for operation of the CPU 72. An input device 74 is made up e.g., of a keyboard, a mouse, a microphone or an external interface, and is acted upon when inputting necessary data or commands. The input device 74 is also adapted to operate as an interface for accepting inputs from outside of digital audio signals furnished to the client terminal 63. An output device 75 is constituted by e.g., a display, a speaker or a printer, and displays and outputs the necessary information. An external memory 76 comprises e.g., a hard disc having stored therein the above-mentioned OS or the pre-set application program. A communication device 77 performs control necessary for communication over the network 62.

The pre-set application program stored in the external memory 76 is a program for causing the functions of the speech encoder 3, transmission path encoder 4 or the modulator 7 to be executed by the CPU 72.

Figure 19:
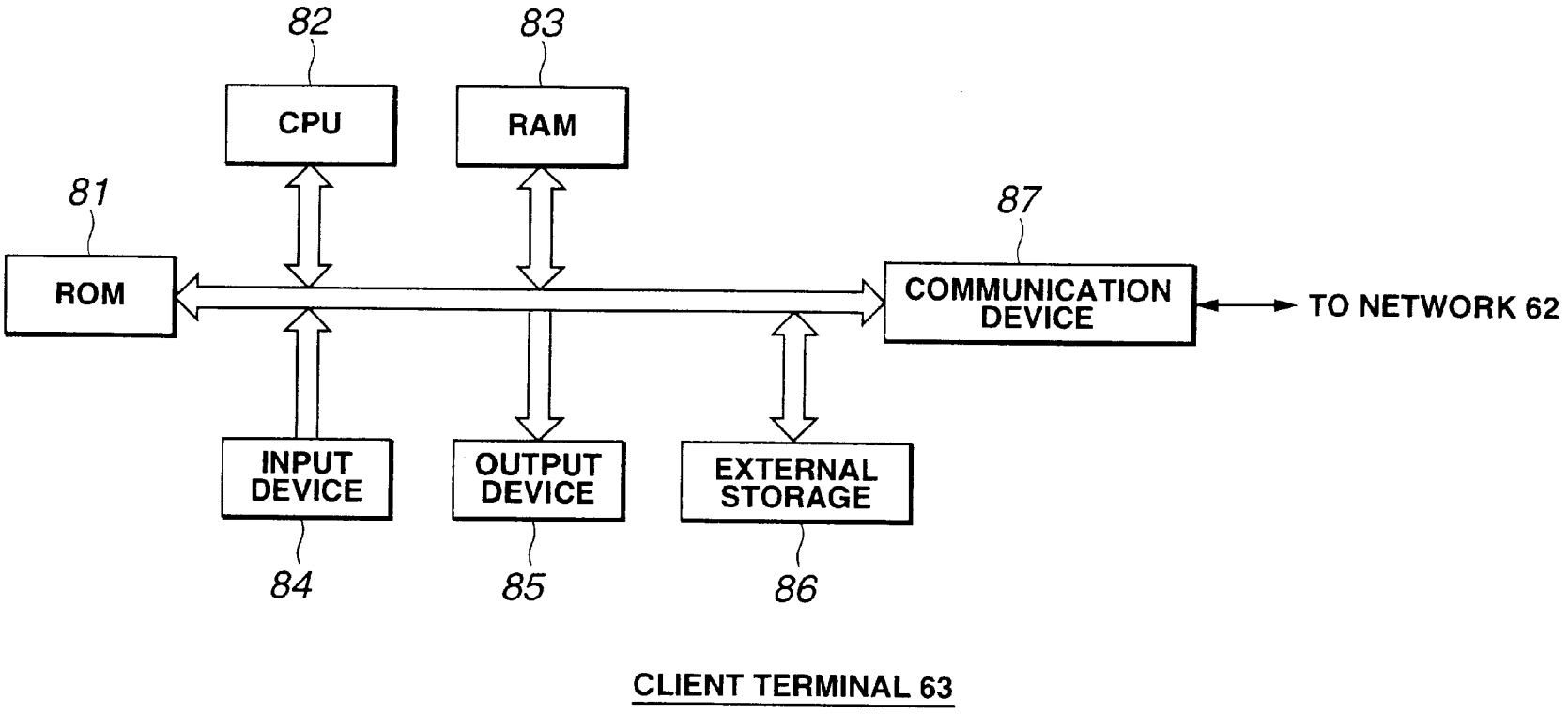
FIG. 19 is a block diagram of a client terminal constituting the transmission system.

FIG. 19 shows an illustrative hardware structure of the client terminal 63 shown in FIG. 17.

The client terminal 63 is made up of a ROM 81 to a communication device 87 and is basically configured similarly to the server 61 constituted by the ROM 71 to the communication device 77.

It is noted that an external memory 86 has stored therein a program, as an application program, for executing the decoding method of the present invention for decoding the encoded data from the server 61 or a program for performing other processing as will now be explained. By execution of these application programs, the CPU 82 decodes or reproduces the encoded data protected against transmission path errors.

Specifically, the external memory 86 has stored therein an application program which causes the CPU 82 to execute the functions of the demodulator 13, transmission path decoder 14 and the speech decoder 17.

Thus, the client terminal 63 is able to realize the decoding method stored in the external memory 86 as software without requiring the hardware structure shown in FIG. 1.

It is also possible for the client terminal 63 to store the encoding data transmitted from the server 61 to the external storage 86 and to read out the encoded data at a desired time to execute the encoding method to output the speech at a desired time. The encoded data may also be stored in another external memory, such as a magneto-optical disc or other recording medium.

Moreover, as the external memory 76 of the server 61, recordable mediums, such as magneto-optical disc or magnetic recording medium, may be used to record the encoded data on these recording mediums.

What is claimed is:

1. A speech encoding apparatus for encoding voiced and unvoiced intervals of an input speech signal at variable bitrates, comprising:

fuzzy inferring means for applying a fuzzy rule;

input signal verifying means for dividing said input speech signal into preset time units, and for verifying whether said unvoiced interval is a background noise interval or a speech interval, using said fuzzy inferring means, based on time changes of a signal level and a spectral envelope of said preset time unit corresponding to said unvoiced interval, wherein allocation of encoding bits is differentiated between parameters of said background noise interval, parameters of said speech interval, and parameters of said voiced interval; and encoding means for encoding said parameters of said voiced interval using a first encoding bitrate, for encoding said parameters of said speech interval using a second encoding bitrate, and for encoding said parameters of said background noise interval using a third encoding bitrate, wherein said second encoding bitrate is lower than said first encoding bitrate and said third encoding bitrate is lower than said second encoding bitrate.

2. The speech encoding apparatus according to claim 1, wherein information indicating the presence or absence of renovation of said parameters of said background noise interval is generated under control based on the time changes of the signal level and the spectral envelope in said background noise interval.

3. The speech encoding apparatus according to claim 1, wherein if said time changes of said signal level and said spectral envelope in said background noise interval are small, information indicating said background noise interval and information indicating the non-renovation of said parameters of said background noise interval are sent out; and if said time changes of said signal level and said spectral envelope in said background noise interval are large, information indicating said background noise interval, renovated background noise parameters, and information indicating the renovation of said parameters of said background noise interval are sent out.

4. The speech encoding apparatus according to claim 3, wherein to limit continuation of parameters indicating background noise in said background noise interval for longer than said preset time unit, said parameters of said background noise interval are renovated at an interval of said preset time unit.

5. The speech encoding apparatus according to claim 1, wherein said parameters of said background noise interval are linear prediction coding coefficients indicating said spectral envelope or indexes of gain parameters of excitation signals of code excitation linear prediction.

6. The speech encoding apparatus according to claim 1, further comprising a decoding apparatus for decoding encoded parameters using variable bitrates, comprising:

verifying means for verifying whether an interval in said encoded parameters is said speech interval or said background noise interval; and decoding means for decoding said encoded parameters in said background noise interval by using linear prediction coding coefficients received concurrently or concurrently and previously, code excitation linear prediction gain indexes received concurrently or concurrently and previously, and code excitation linear prediction shape indexes generated internally at random.

7. The decoding apparatus according to claim 6, wherein said decoding means generates signals of said background noise interval by interpolating said linear prediction coding coefficients received previously and concurrently, or by interpolating said linear prediction coding coefficients received previously, wherein random numbers are used for generating interpolating coefficients of said linear prediction coding coefficients.

8. A speech encoding method for encoding voiced and unvoiced intervals of an input speech signal at variable bitrates, comprising:

a fuzzy inferring step for applying a fuzzy rule;

an input signal verifying step for dividing said input speech signal into preset time units, and for verifying whether said unvoiced interval is a background noise interval or a speech interval, using said fuzzy inferring step, based on time changes of a signal level and a spectral envelope of said preset time unit corresponding to said unvoiced interval, wherein allocation of encoding bits is differentiated between parameters of said background noise interval, parameters of said speech interval, and parameters of said voiced interval; and an encoding step for encoding said parameters of said voiced interval using a first encoding bitrate, for encoding said parameters of said speech interval using a second encoding bitrate, and for encoding said parameters of said background noise interval using a third encoding bitrate, wherein said second encoding bitrate is lower than said first encoding bitrate and said third encoding bitrate is lower than said second encoding bitrate.

9. The speech encoding method according to claim 8, further comprising a decoding method for decoding encoded parameters using variable bitrates, comprising the steps of:

verifying whether an interval in said encoded parameters is said speech interval or said background noise interval; and decoding said encoded parameters in said background noise interval by using linear prediction coding coefficients received concurrently or concurrently and previously, code excitation linear prediction gain indexes received concurrently or concurrently and previously, and code excitation linear prediction shape indexes generated internally at random.

* * * * *